United States Patent [19]

Akeret

[11] 4,132,078

[45] Jan. 2, 1979

[54] PISTON MACHINE

[75] Inventor: Richard Akeret, Winterhur, Switzerland

[73] Assignee: Enginor AG, Switzerland

[21] Appl. No.: 804,173

[22] Filed: Jun. 6, 1977

[30] Foreign Application Priority Data

Jul. 27, 1976 [CH] Switzerland ..... 9607/76
Nov. 9, 1976 [CH] Switzerland ..... 14109/76

[51] Int. Cl.[2] ..... F02C 1/02

[52] U.S. Cl. ..... 60/682; 60/669; 92/120; 418/38

[58] Field of Search ..... 60/370, 407, 650, 682, 60/669; 91/180, 217; 92/120; 418/34, 38; 123/245

[56] References Cited

U.S. PATENT DOCUMENTS

| | | | |
|---|---|---|---|
| 290,871 | 12/1883 | Eberhard | 92/120 X |
| 1,256,647 | 2/1918 | Baudot | 418/34 X |
| 3,645,239 | 2/1972 | Cena | 418/34 X |

*Primary Examiner*—Allen M. Ostrager
*Assistant Examiner*—Stephen F. Husar
*Attorney, Agent, or Firm*—Hill, Gross, Simpson, Van Santen, Steadman, Chiara & Simpson

[57] ABSTRACT

A piston machine has arcuately-curved, cooperating pistons and cylinders arranged on the periphery of a pair of coaxially mounted rotatable disks or arms. Swiveling movements of the disks, causing the pistons to move in the cylinders, are controlled by cams and connecting gears. The cams are fixed with respect to the disks. Each cam is scanned by a cam follower connected by an arm to a shaft journaled in one of the disks. A connector gear is affixed to the cam follower and connector gear shaft to drive the disk opposite the disk in which the connector gear shaft is carried. Gear segments on the external periphery of each disk engage interchangeably a driven shaft for power output where work is produced by the machine as in compressed air and heat engine embodiments disclosed or for power input where the machine does work on the compressible fluid as in a compressor embodiment. In the motor embodiments each of a pair of axial gears coaxial with the disks' axis and rotatable in one direction only is engageable with a second connector gear affixed to the cam follower and connector gear shaft. Valves on the disks control flow of the compressible fluid. In the heat engine embodiment, a first piston compresses gas for heating and expansion to drive the second, operating piston. Each piston is externally honed to seal circumferentially with a ring carried in the cylinder mouth.

24 Claims, 26 Drawing Figures

16
18,18a
3a
3
108°
2a
17
17a
2
14,14a
13a
12a
5,5a
D
15
10a
9a
7
1
94°
11
13
12
10
75,2°
15a
18,8°
17
17a

122°
16
18,18a
17a
17
2a
3
3a
2
13a
14,14a
12a
5,5a
15
10a
9a
D
104 5°
1
7
11
13
12
9
83,6°
10
15a
20,9°
17
17a 5
5a
D
10a
9a
15
R1
R4
1

D
14a
13a
9a
12
14a
13a
1
14
13
12a
13
14
9
α
α
β

PISTON MACHINE

BACKGROUND OF THE INVENTION

The invention relates to piston machines having arcuately curved pistons and cooperating cylinders each rotating circumferentially in a circular path on separate, relatively swingable supporting parts carried about a machine shaft fixed in a housing and working with a compressible fluid. Combustion engines are known having pistons rotating in an annular or ring cylinder and having lagging counter-pistons to control fluid compression. Control of piston movements in such engines occurs through levers and gears. Forces imposed by explosions in the cylinders of combustion engine embodiments have not been satisfactorily controlled, so such motors have never been produced in volume. Other combustion engines have been proposed having constantly rotating cylinders and stepwise rotating pistons moving in a circular path and controlled by a lever system. Such motors also have control and sealing problems. Such machines also have had drives which could inadvertently lock or levers which could depart from their control paths.

In view of the state of the art, an object of the invention is to provide a piston machine successfully utilizing the advantages of rotational movement of pistons and cylinders.

SUMMARY OF THE INVENTION

A piston machine has a pair of corotating disks or arms arranged to swivel with respect to one another to effect relative reciprocation of pistons and cylinders carried respectively on one or the other of the disks or arms. The disks or arms are alternately and sequentially connected to a drive shaft for power output or input. The swivelling movement is controlled by a pair of identical, fixed cams arranged in the machine housing, a pair of cam followers each carried on a rotatable shaft carried in each disk, and a pair of connecting gears each affixed to one of the shafts and engaging a gear sector on the opposite disk. Such system is mechanically closed. In motor embodiments, the disk movement is further controlled by a pair of second connecting gears each affixed to one of the shafts and a pair of unidirectionally rotating axial gears engageable therewith, whereby the disk not engaged with the drive shaft is swivelled ahead at a controlled rate and the other disk puts out power to such driven shaft by reacting against the non-rotating or stopped axial gear. Roller valves carried in the cylinder-supporting disk control the compressible working fluid. The curved pistons are honed about their peripheries for sealing with rings fixed near a mouth of each of the cylinders.

IN THE DRAWINGS

FIG. 1*a* is a side elevational view, partly in section, of portions of a piston machine driven by compressed air.

FIG. 1*b* is a generally front, elevational view of the compressed air motor of FIG. 1*a*, taken in the direction of the arrow I*b* in FIG. 1*a*, and showing at I*a*—I*a* the relative position of the FIG. 1*a*.

FIG. 2*a* is a side sectional view through the drive mechanism of the piston machine.

FIG. 2*b* is a longitudinal section through the compressed air machine, taken on line II*b*—II*b* of FIG. 2*a*, and showing therein the orientation of the section II*a*—II*a* on which FIG. 2*a* is taken.

FIGS. 3*a* and 3*b* are broken sections taken on lines III*a*—III*a* and III*b*—III*b*, respectively, of FIG. 2*a*, through the piston and cylinder mechanisms of the compressed air machine.

FIGS. 4*a* and 4*b* depict schematically the positions of the supporting disks for the pistons and the cylinders, respectively, upon mating or meshing between the drive gear segments thereof and upon demeshing from same, respectively.

Figure 7:
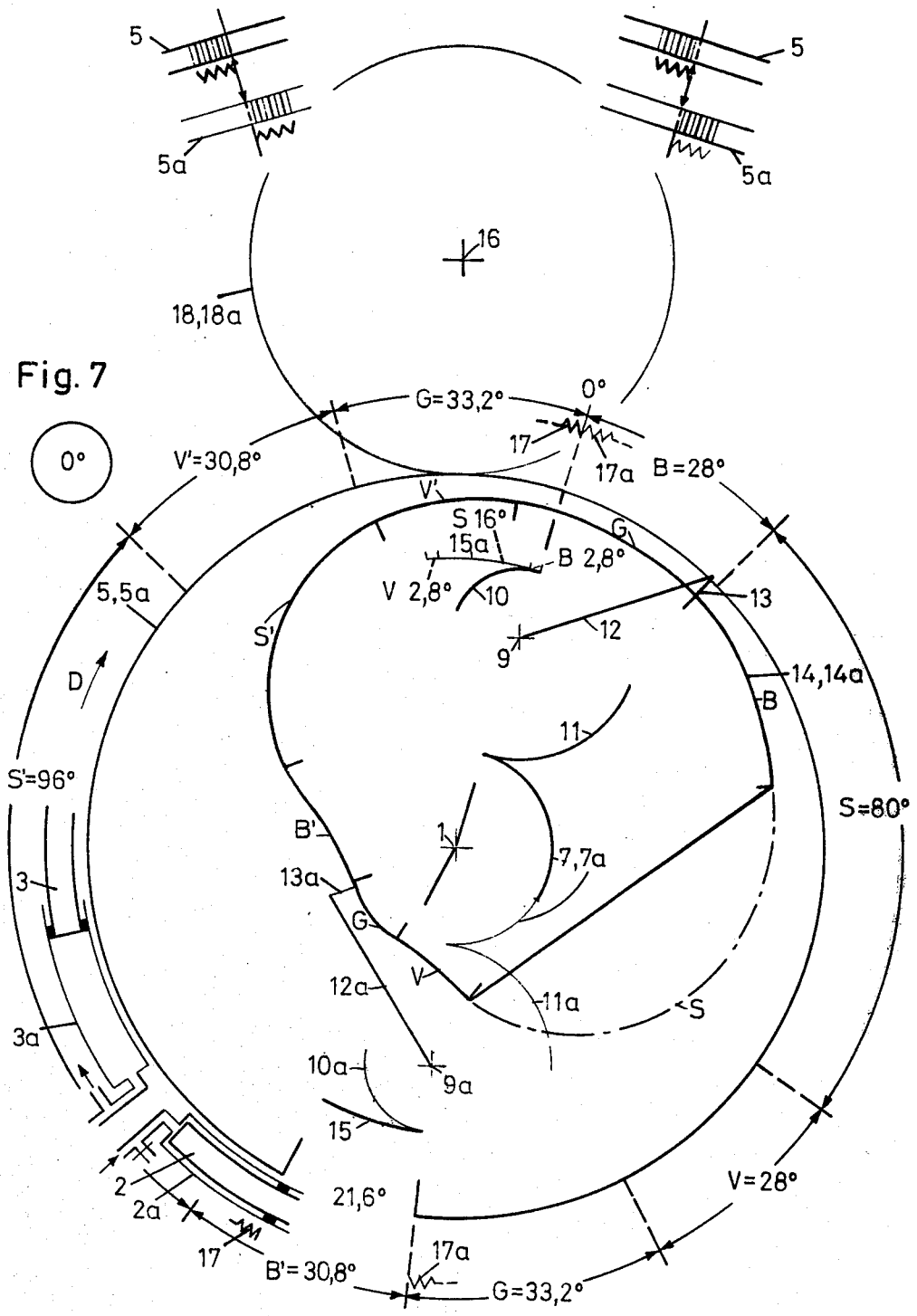
FIG. 7 shows schematically a number of the important interrelationships between the rotational movement and the relative swinging movement in a motor embodiment of the piston machine, wherein the disk meshing with the output gear is at zero degrees of rotation.
Figure 7A:
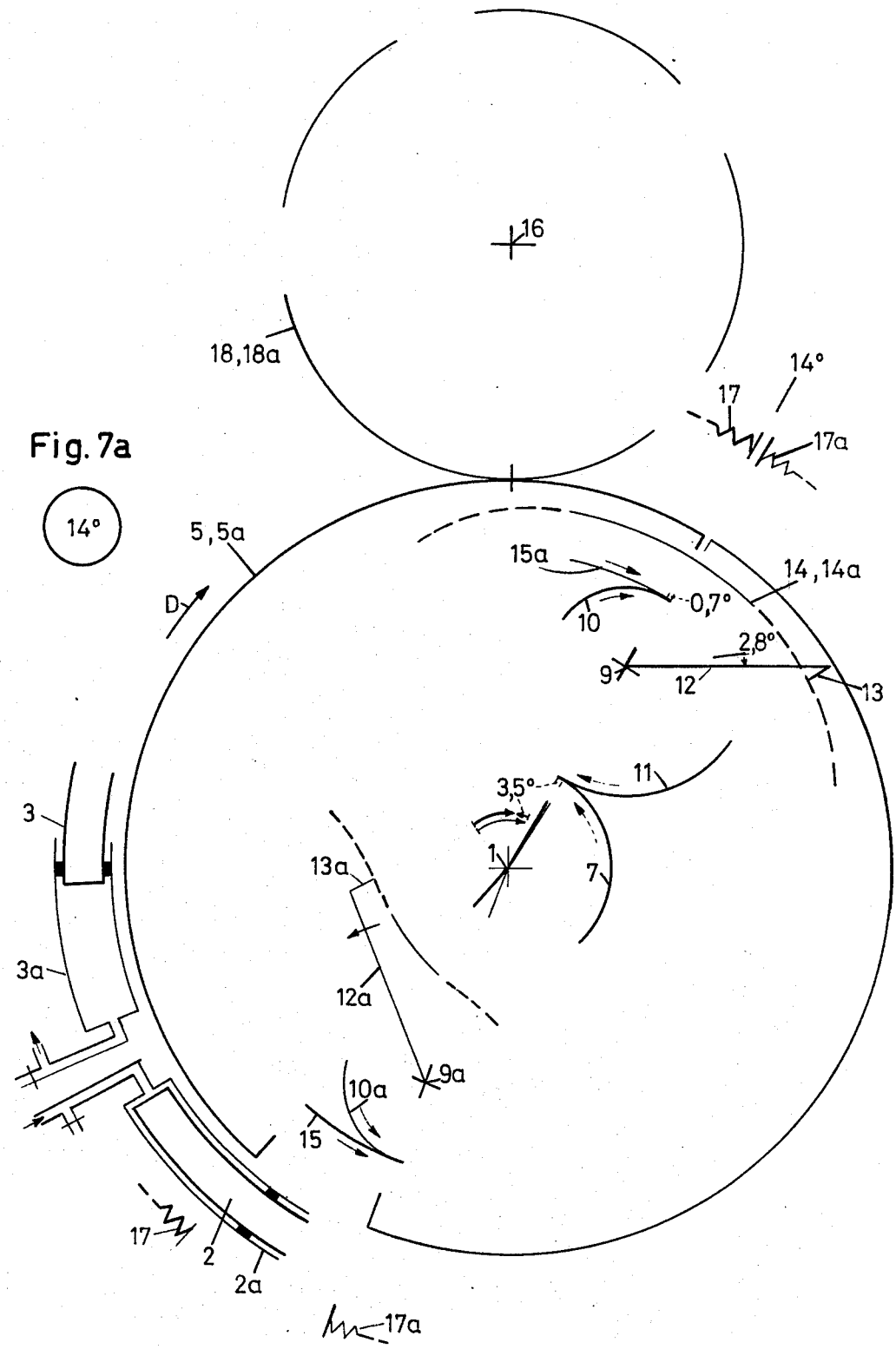

FIG. 7*a* shows the interrelationships of FIG. 7 after a rotation of the meshing disk of 14°.

Figure 7B:
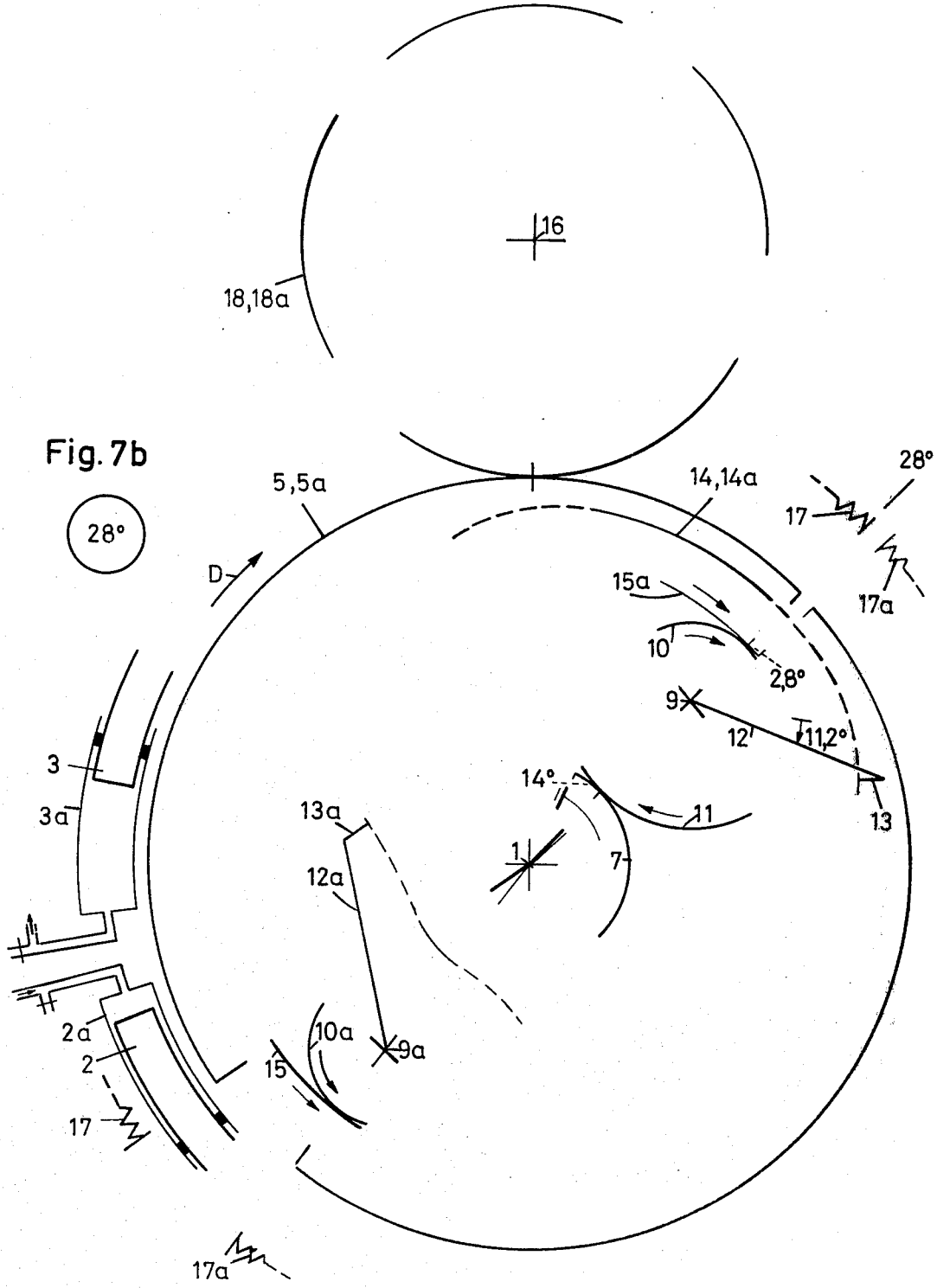

FIG. 7*b* shows the diagram of FIG. 7 at a rotational angle of 28°, where the non-meshing disk has been accelerated and the power stroke is beginning.

Figure 7C:
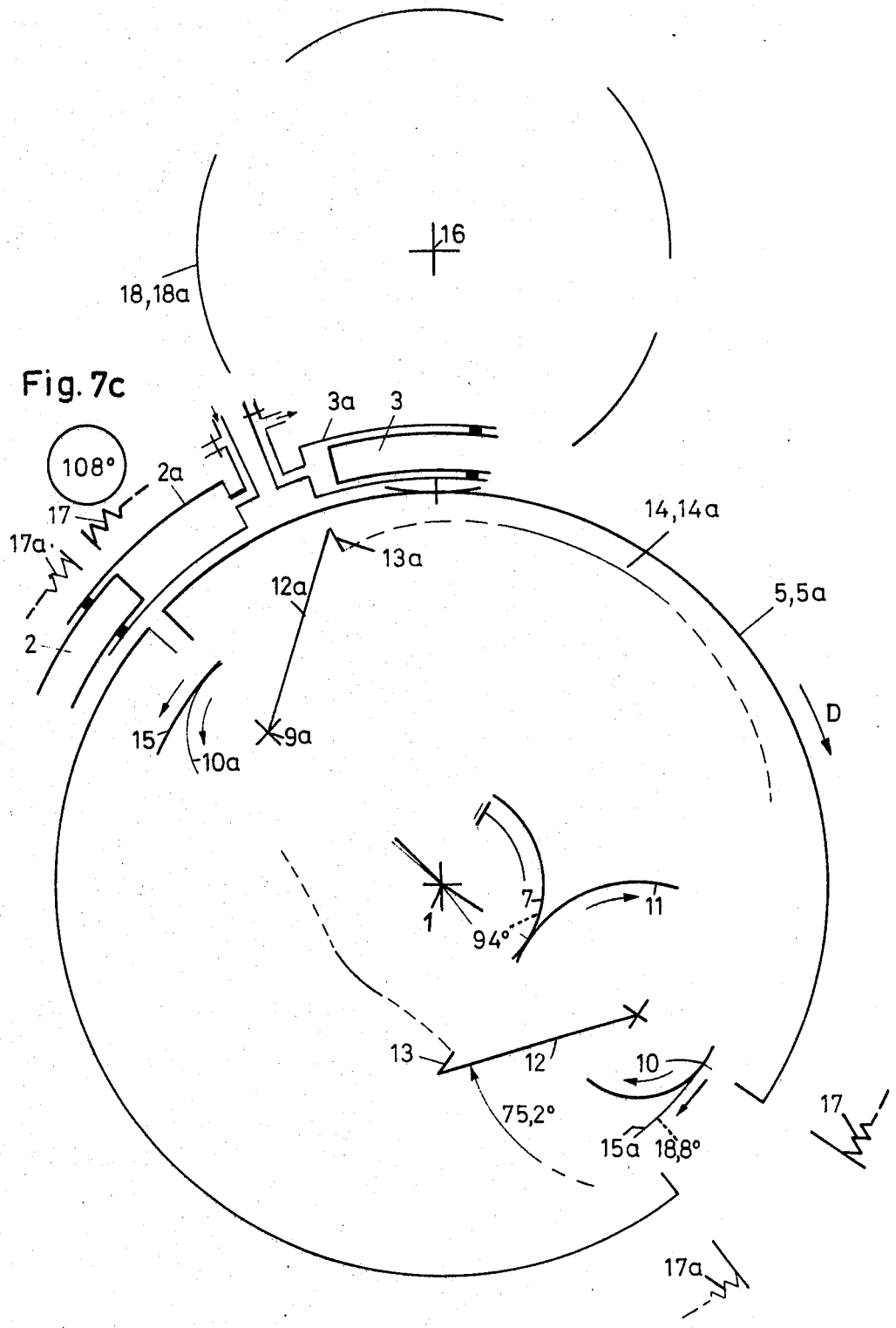

FIG. 7*c* shows the interrelationships of FIG. 7 at a rotational angle of the meshing disk of 108°, at the end of the power stroke.

Figure 7D:
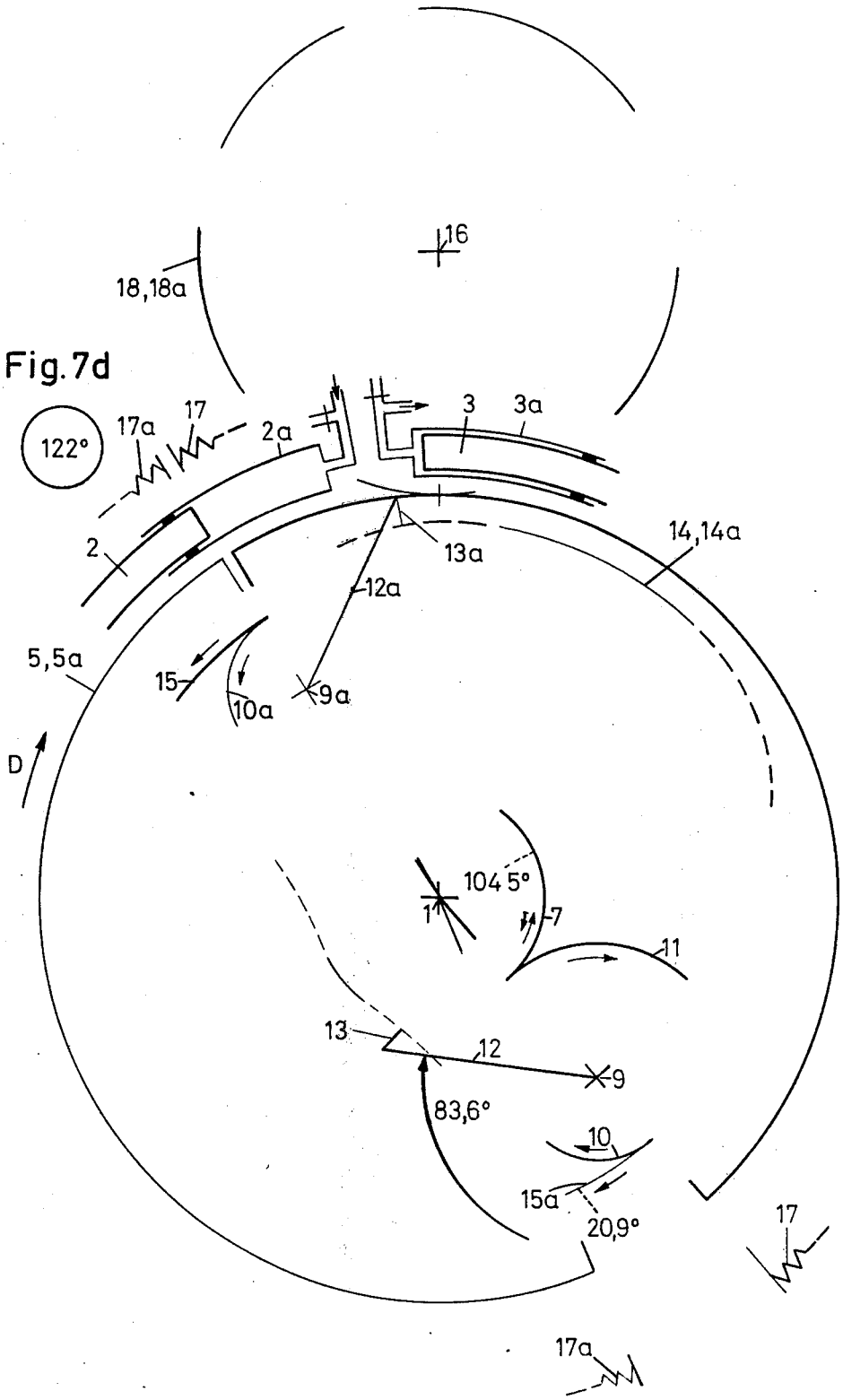

FIG. 7*d* shows the interrelationships of FIG. 7 at a rotational angle of 122°.

Figure 7E:
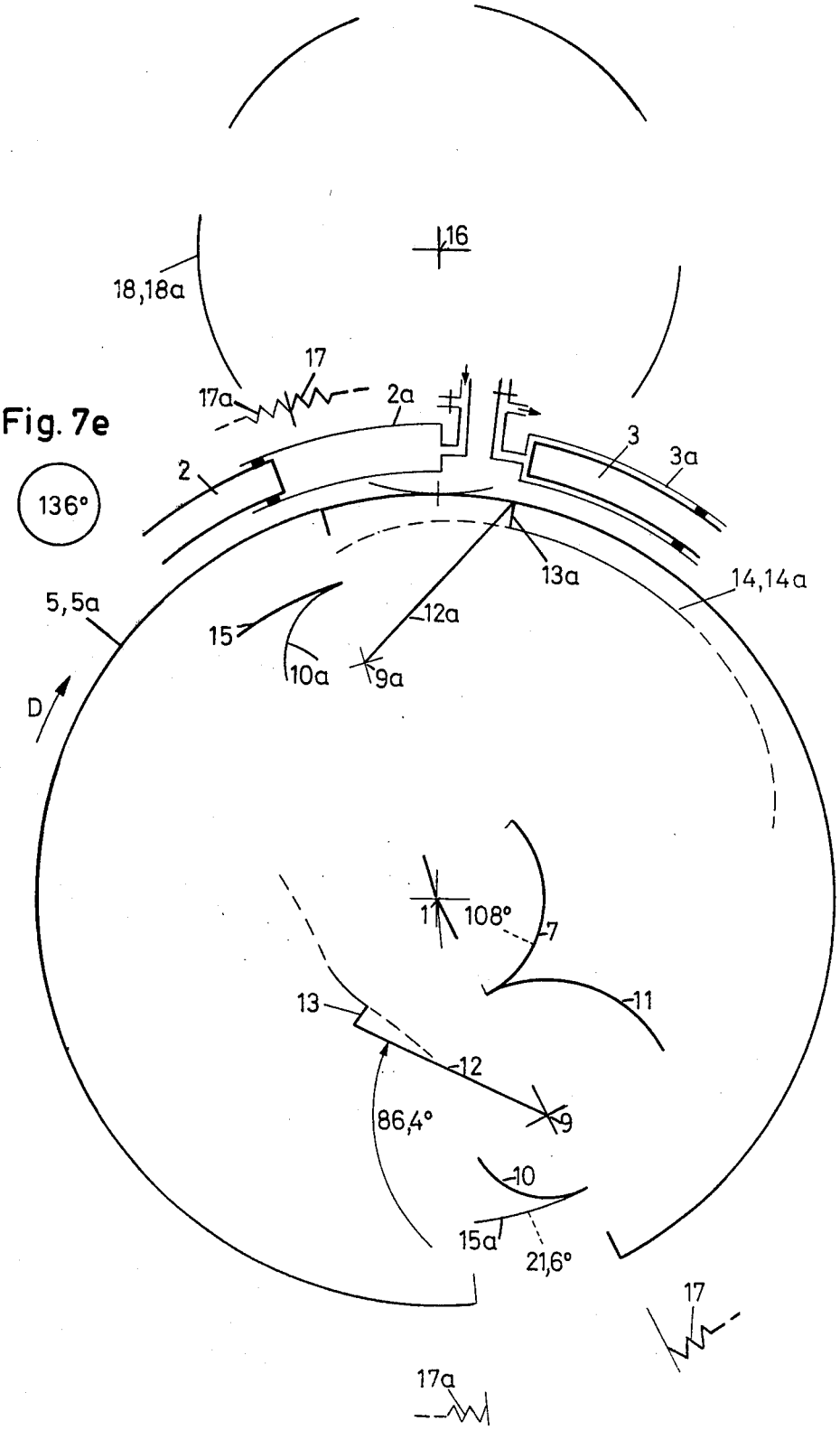

FIG. 7*e* shows the interrelationships of FIG. 7 at a rotational angle of 136°, wherein the meshing and non-meshing disks begin to run at the same rotational speed.

Figure 7F:
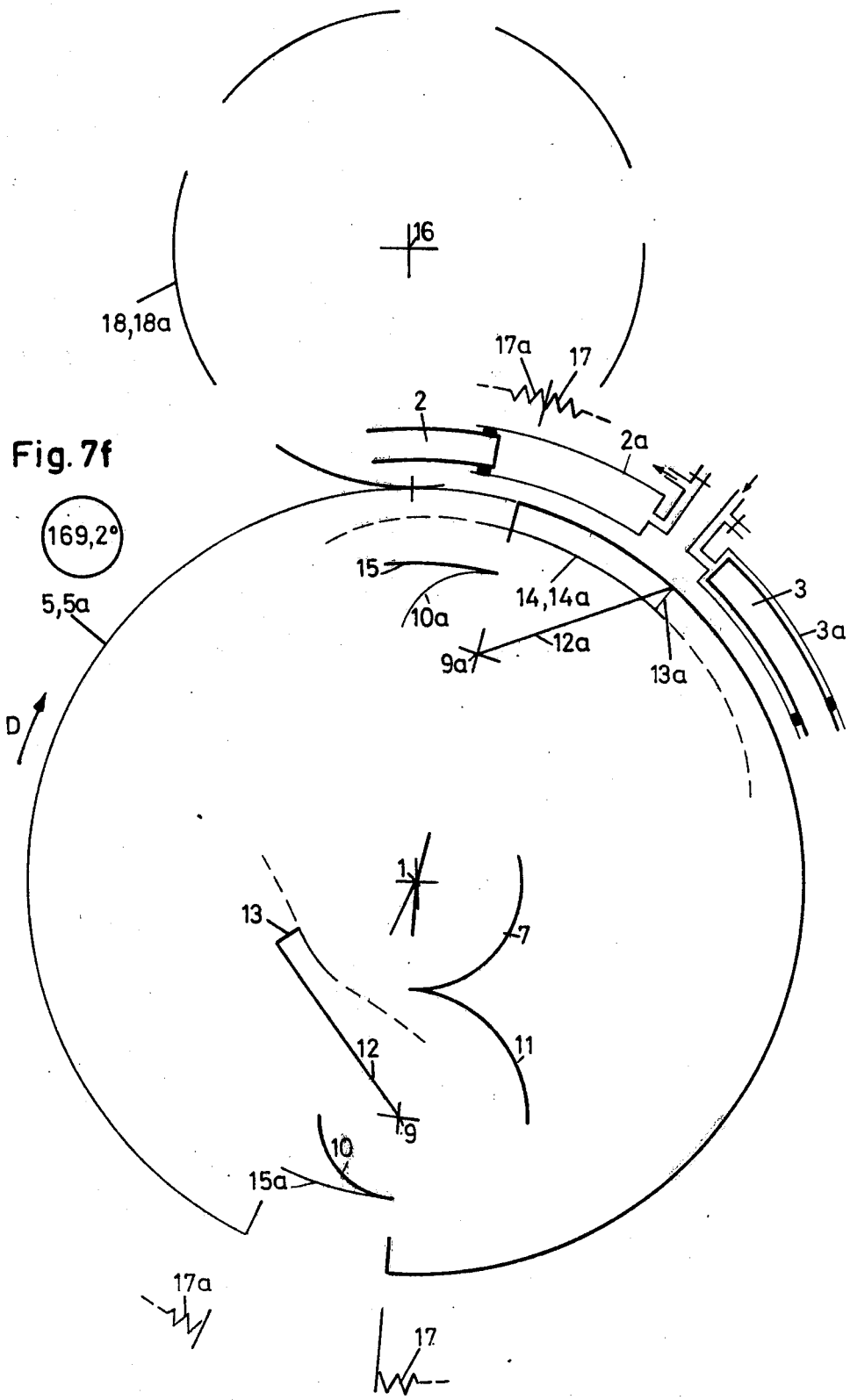

FIG. 7*f* shows the interrelationships according to FIG. 7 at the end of the period of synchronous rotation, wherein the meshing disk is rotated through 169.2° and comes out of meshing engagement with the output shaft, and the previously non-meshing disk is rotated through 190.8°.

Figure 8:
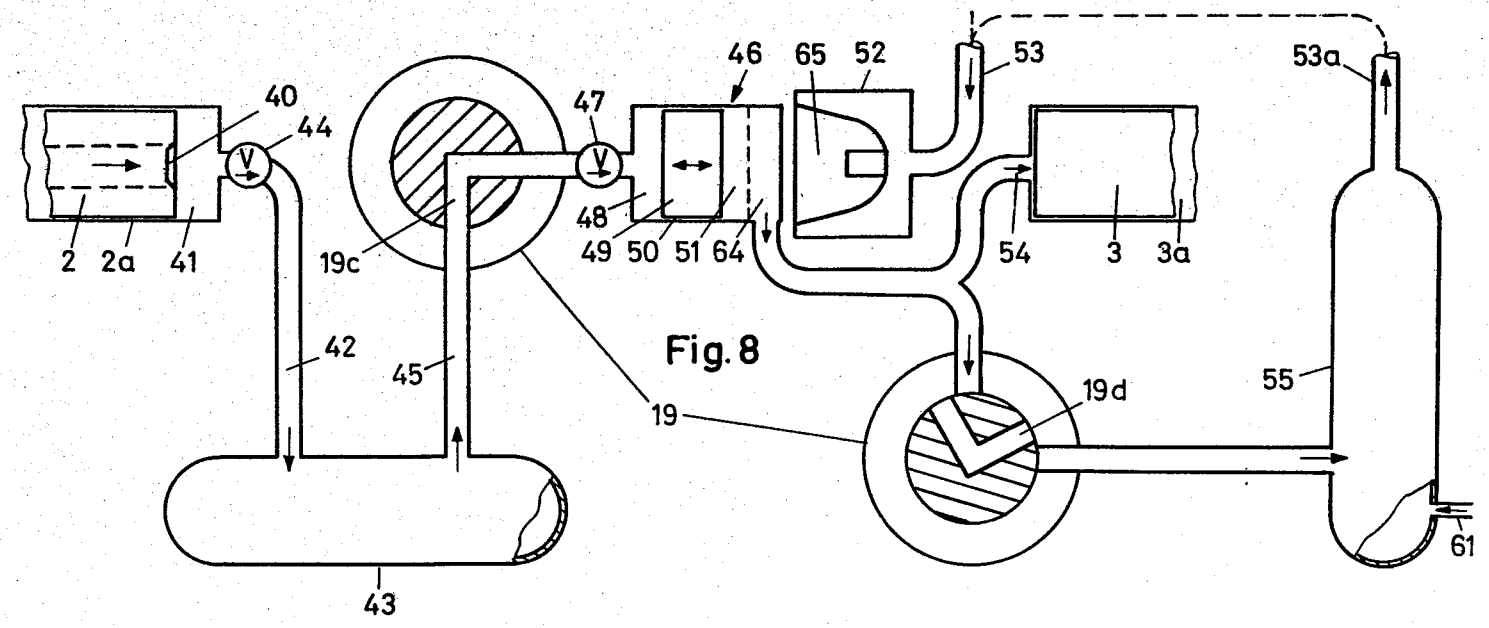

FIG. 8 depicts schematically the elements of a hot air motor embodiment.

Figure 9:
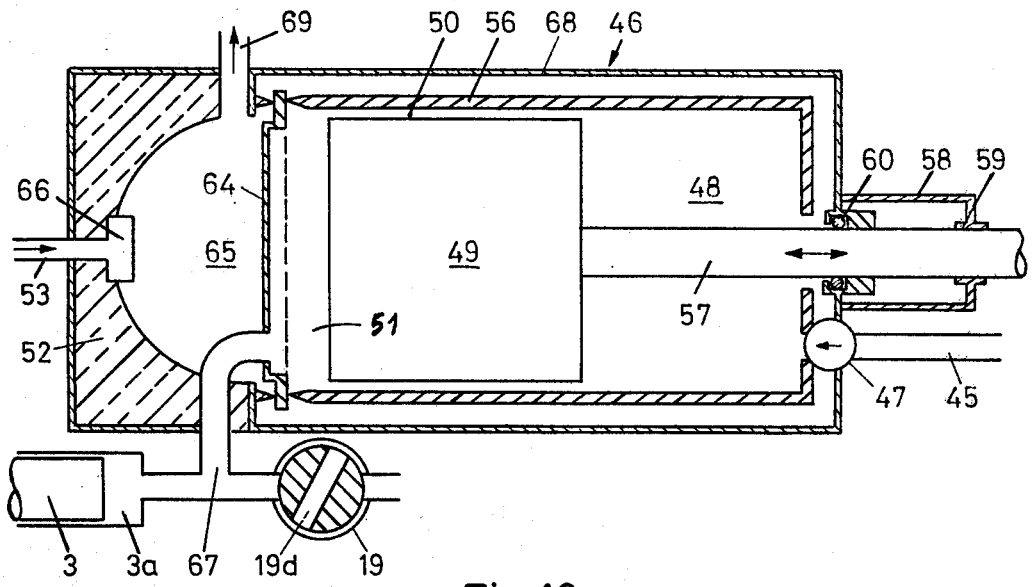

FIG. 9 is a longitudinal cross sectional view through a heater element of a hot air motor machine.

Figure 10:
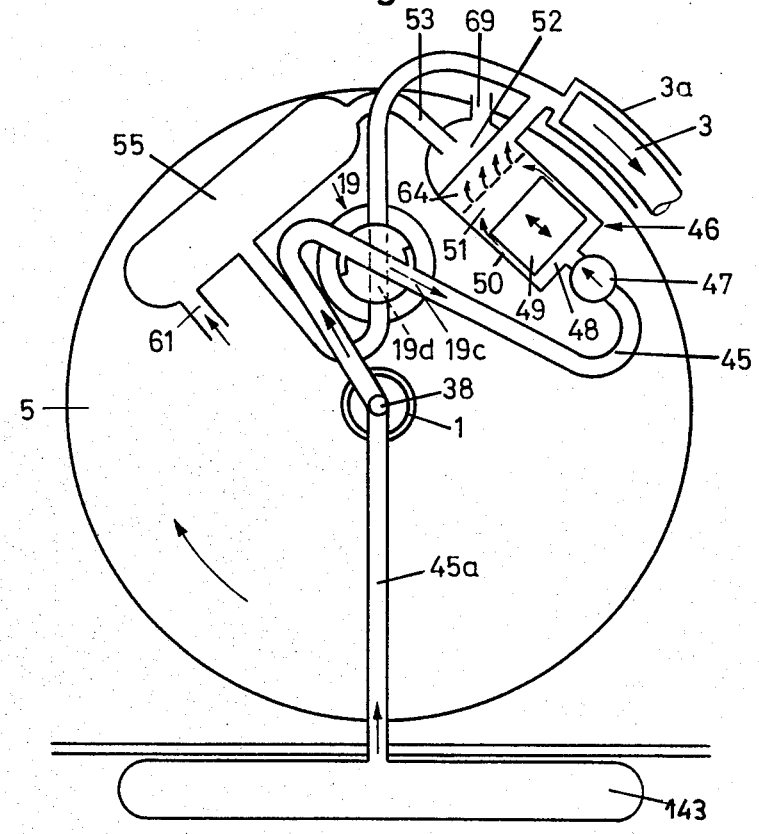

FIG. 10 is a partly schematic plumbing diagram for a hot air motor embodiment using a stationary compressed air source.

Figure 11:
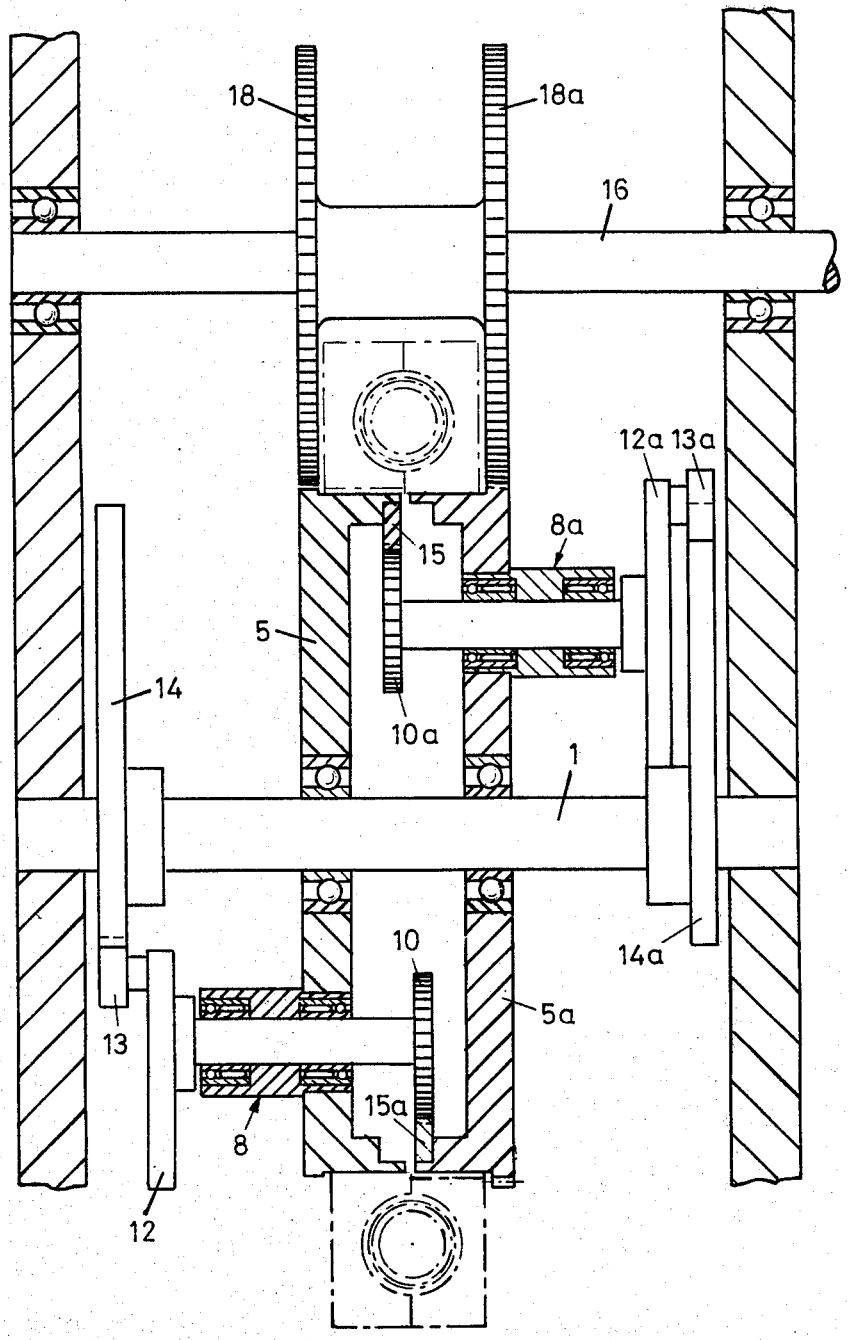

FIG. 11 is a longitudinal view, mostly in section, through a piston machine constructed as a compressor.

Figure 12:
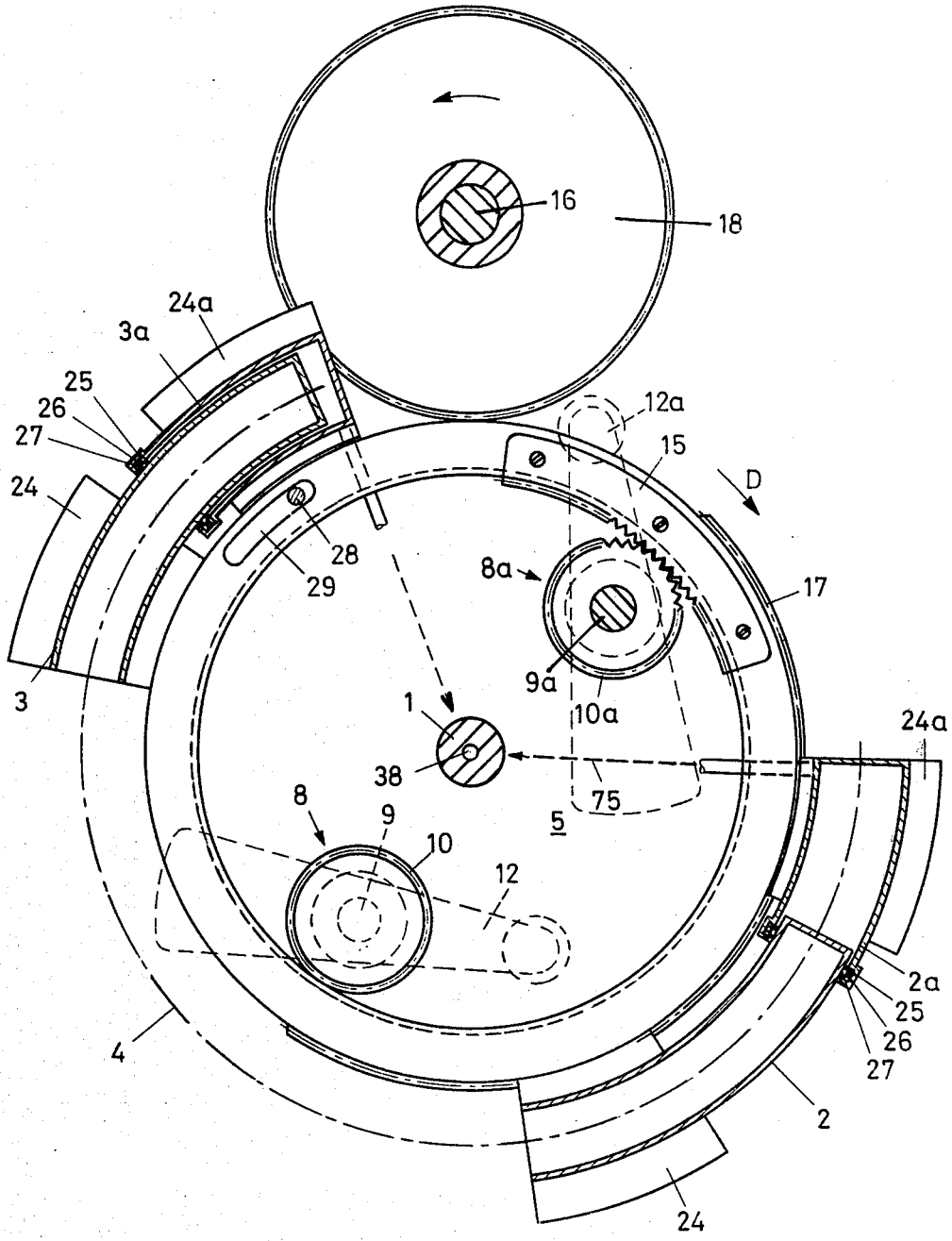

FIG. 12 is a side, partially sectional view through the air compressor of FIG. 11.

Figure 13:
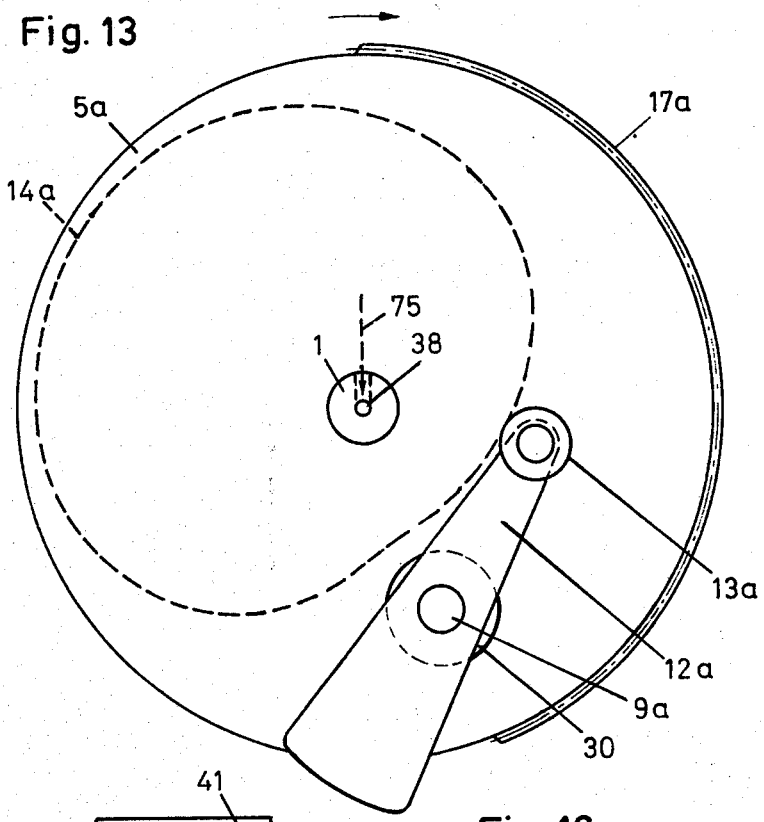

FIG. 13 is a side elevational view of one of the supporting disks with related control mechanism.

Figure 14:
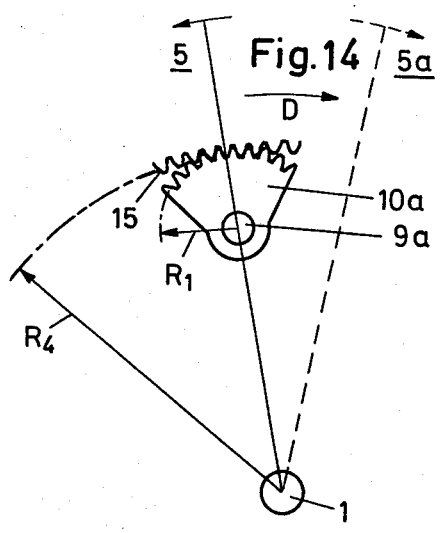

FIG. 14 is a schematic illustration of the kinematics of a gear part of the air compressor of FIG. 11.

Figure 15:
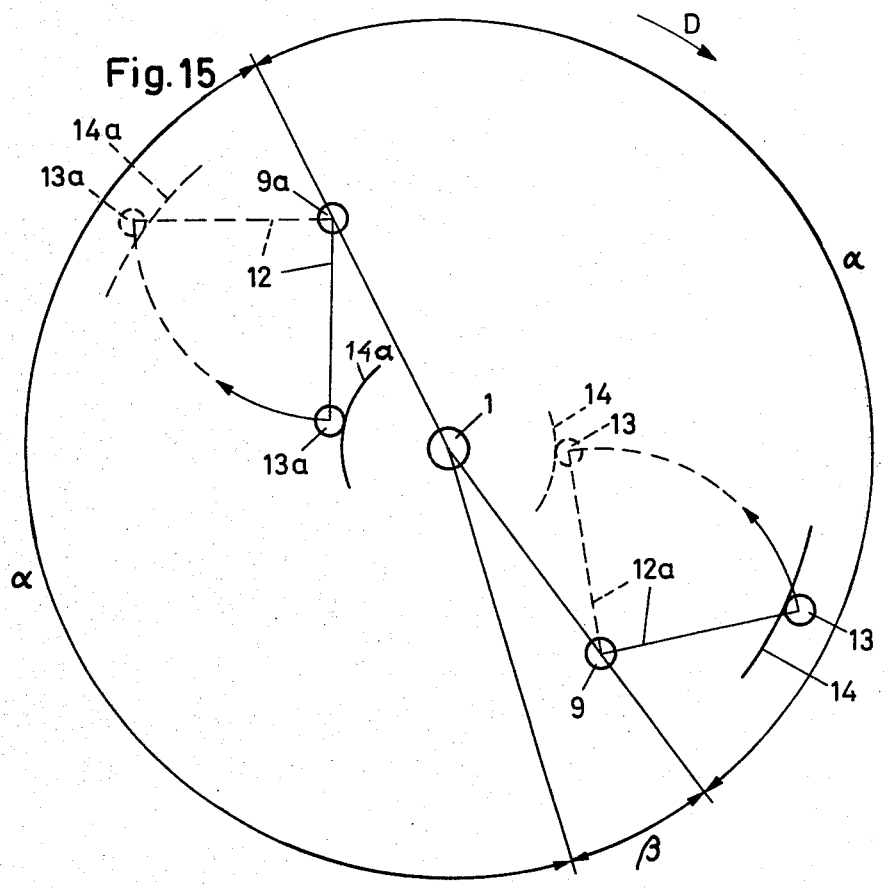

FIG. 15 is a kinematic diagram showing interrelationships among parts of the air compressor mechanism of FIG. 11.

Figure 16:
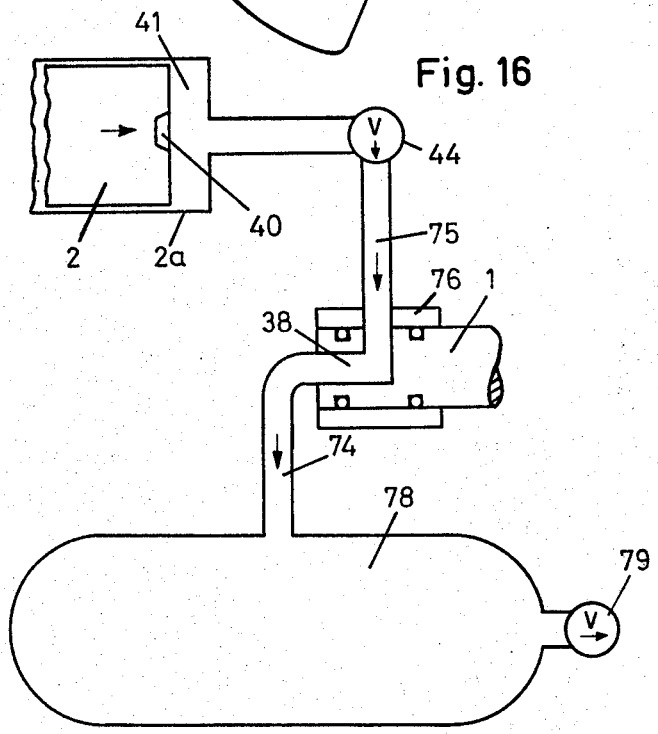

FIG. 16 is a schematic illustration of the connection of the piston cylinder units of the air compressor to the pressure output tank.

THE PREFERRED EMBODIMENTS

I. Compressed Air Machine

Figure 1A:
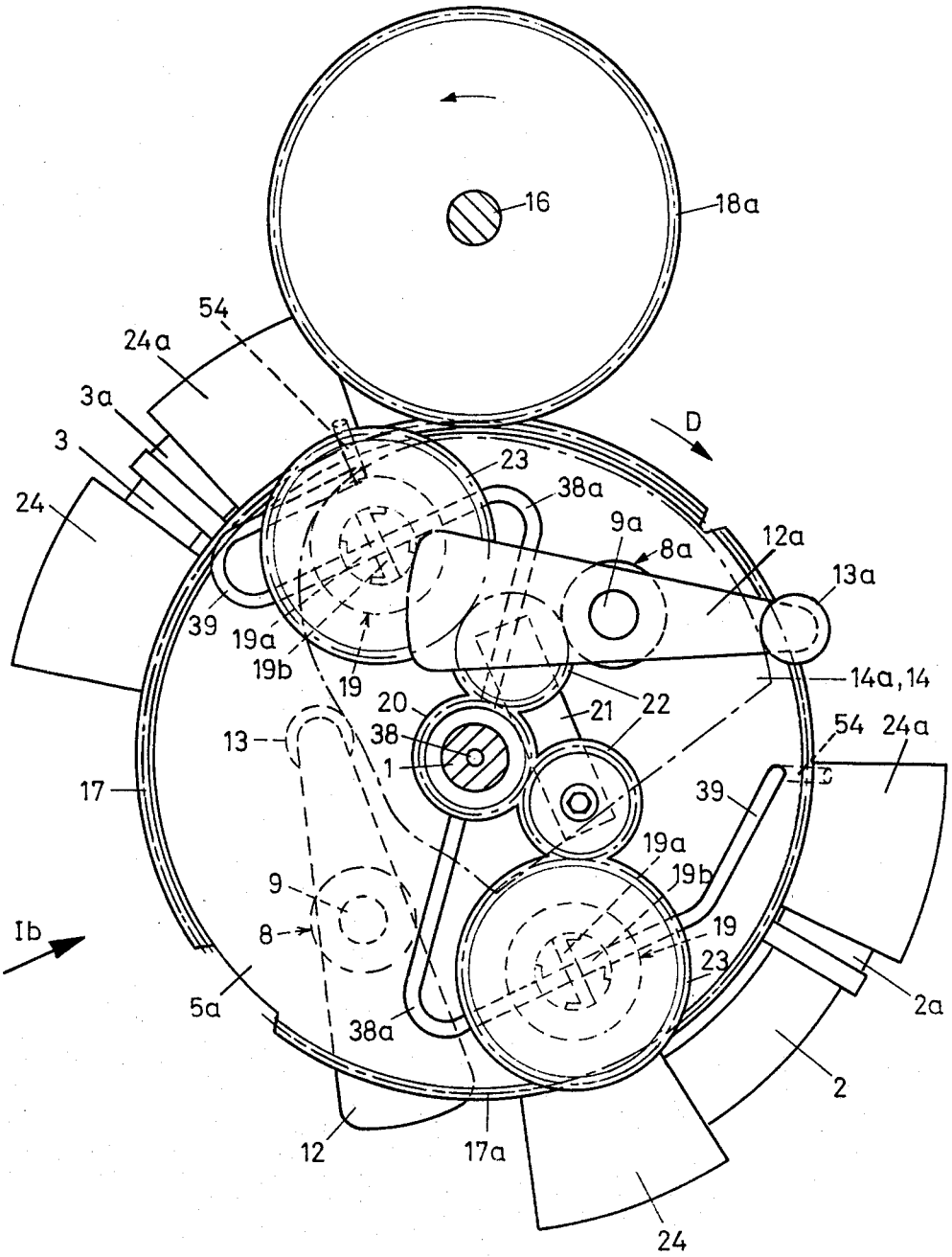
Figure 1B:
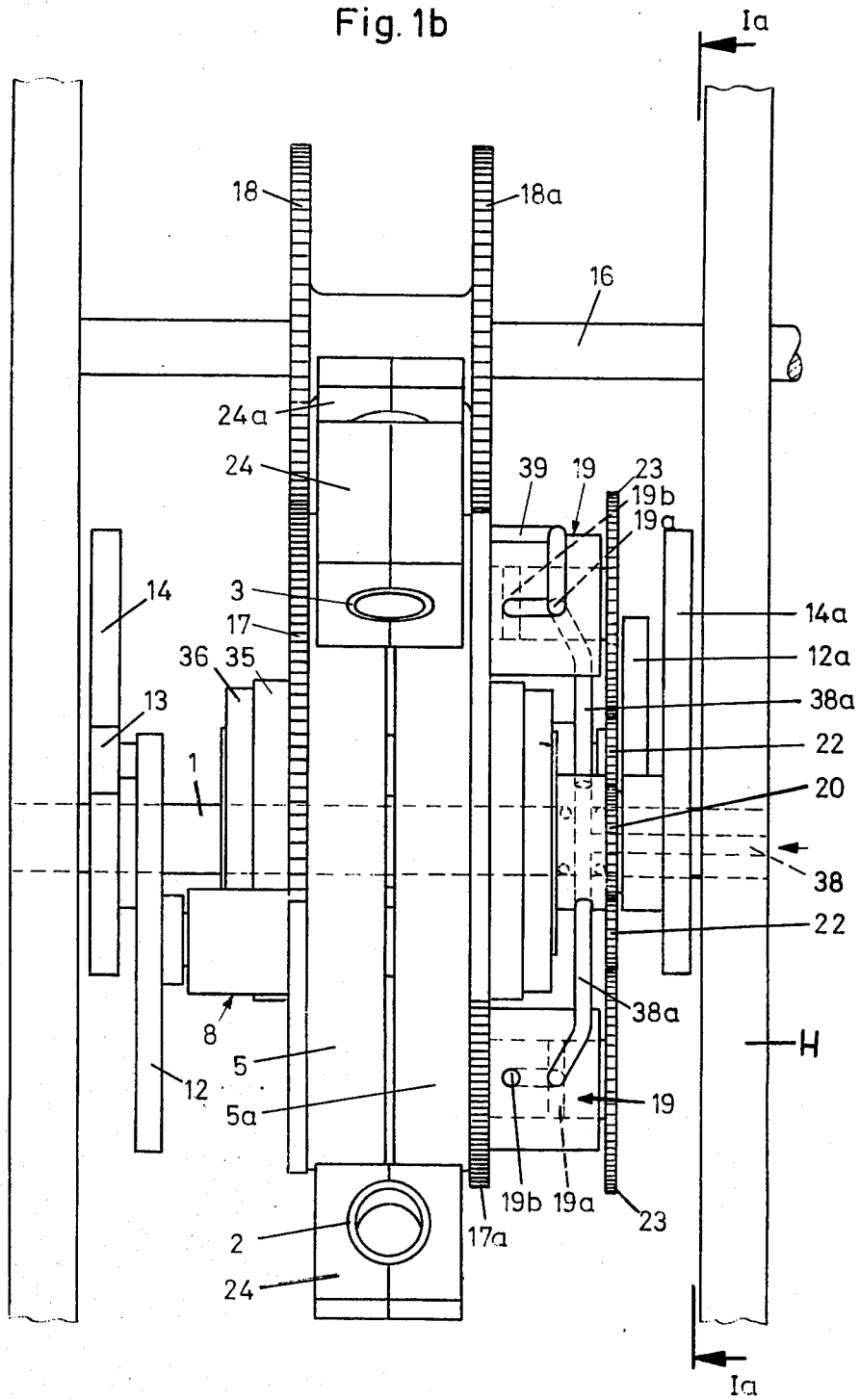
Figure 2A:
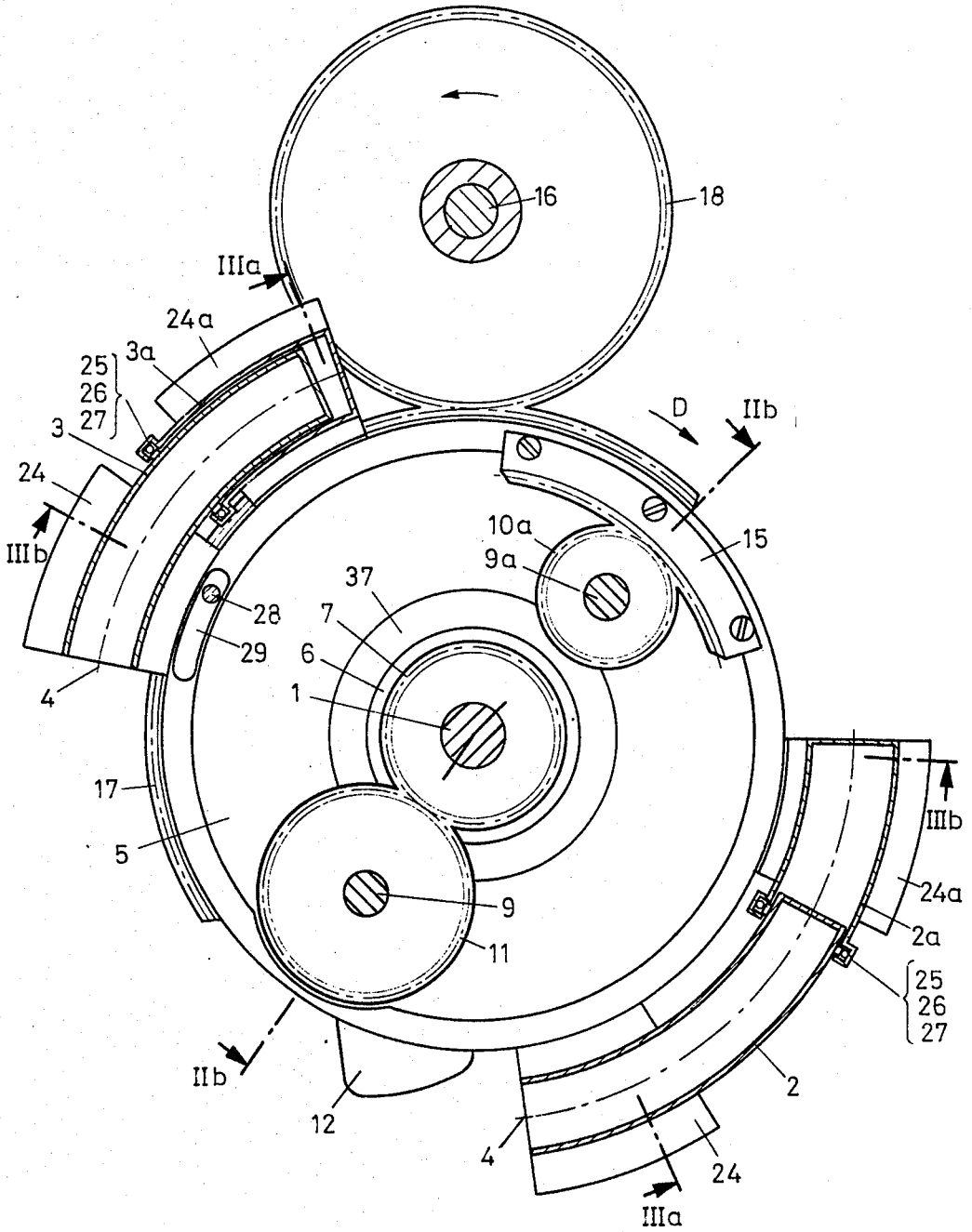
Figure 3A:
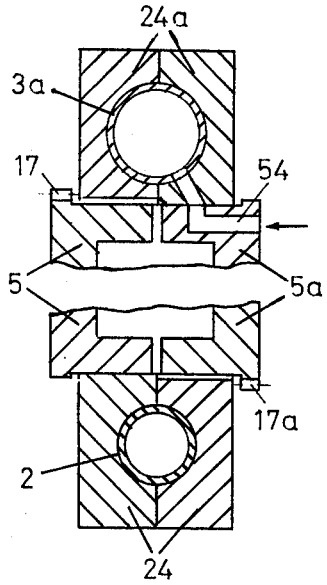
Figure 3B:
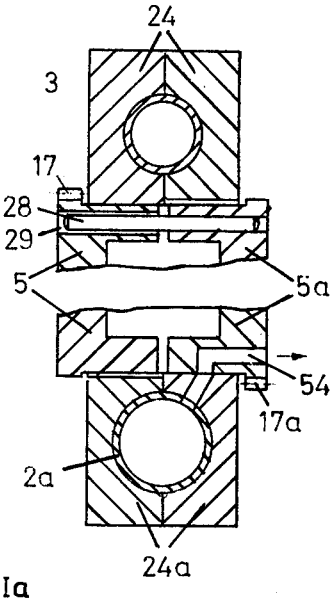
Figure 2B:
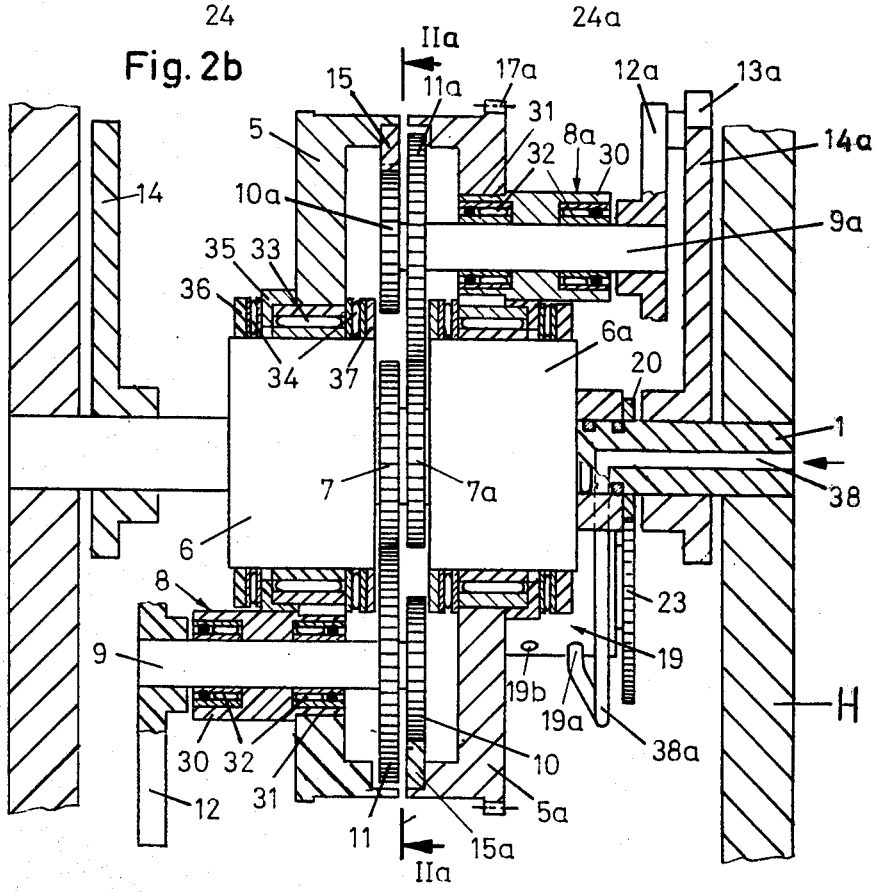

The piston machine shown in the drawings is driven in a first embodiment by means of compressed air. The machine has two pistons 2, 3 and two cylinders 2*a*, 3*a* which are rotatable in direction D about a machine shaft 1 fixed on a housing H. The pistons 2, 3 and cylinders 2a, 3a are curved or arcuately shaped and have axes lying on a circle 4, as shown in FIG. 2a. Both piston-cylinder groups 2, 2a; 3, 3a are fixed for selected relative movement between the pistons and cylinders on the periphery of a pair of supporting arms or disks 5, 5a which are freely rotatable on the machine shaft 1. One supporting disk 5 carries the two pistons 2, 3 and the other supporting disk 5a carries the cylinders 2a, 3a. The compressed air is supplied from one side of the machine, through a bore 38 in the shaft 1 and to the cylinder disk 5a, which simplifies the control.

Hubs 6, 6a rotatably carry the disks 5, 5a and are arranged rotatably at an axial spacing from one another on the machine shaft 1. Each hub 6, 6a carries affixed thereto an axial gear 7 or 7a, as in FIG. 2a. The hubs and gears 6, 7; 6a, 7a are freely rotatable in the direction of rotation of the disks 5, 5a and are locked against the main shaft 1, as by a conventional one-way internal clutch, against rotation in the counterdirection. The two sets of hubs and axial gears 6, 7; 6a, 7a are independent of one another except through other connections in the motor.

Connector gear assemblies 8, 8a each comprise a connector gear shaft 9 or 9a carried rotatably in the disk 5 or 5a parallel to but spaced radially from the machine shaft 1. Each assembly 8, 8a carries on an axially inner side of the disks 5, 5a two connector gears 10, 11; 10a, 11a, respectively. On the axially outer end of each shaft 9, 9a is fixed a cam lever 12 or 12a, respectively. Each cam lever 12, 12a has a cam-engaging wheel 13 or 13a, respectively, mounted thereon opposite the shaft 9, 9a. The wheels 13, 13a run about stationary cams 14, 14a, respectively, fixed in the housing H. The two cams 14, 14a are identical in shape to one another and are fixed in the housing H at the same orientation.

Figure 6:
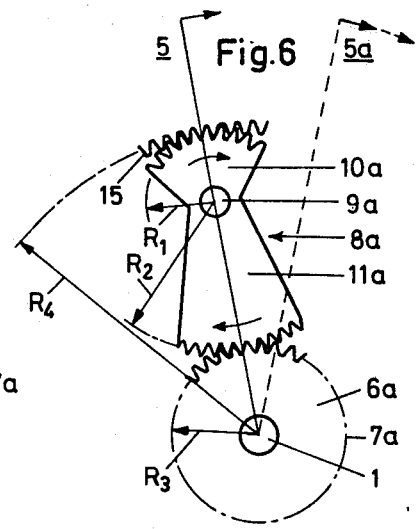
FIG. 6 shows diagrammatically the kinematics of the pair of connecting gears on one of the gear shafts.
Figure 5:
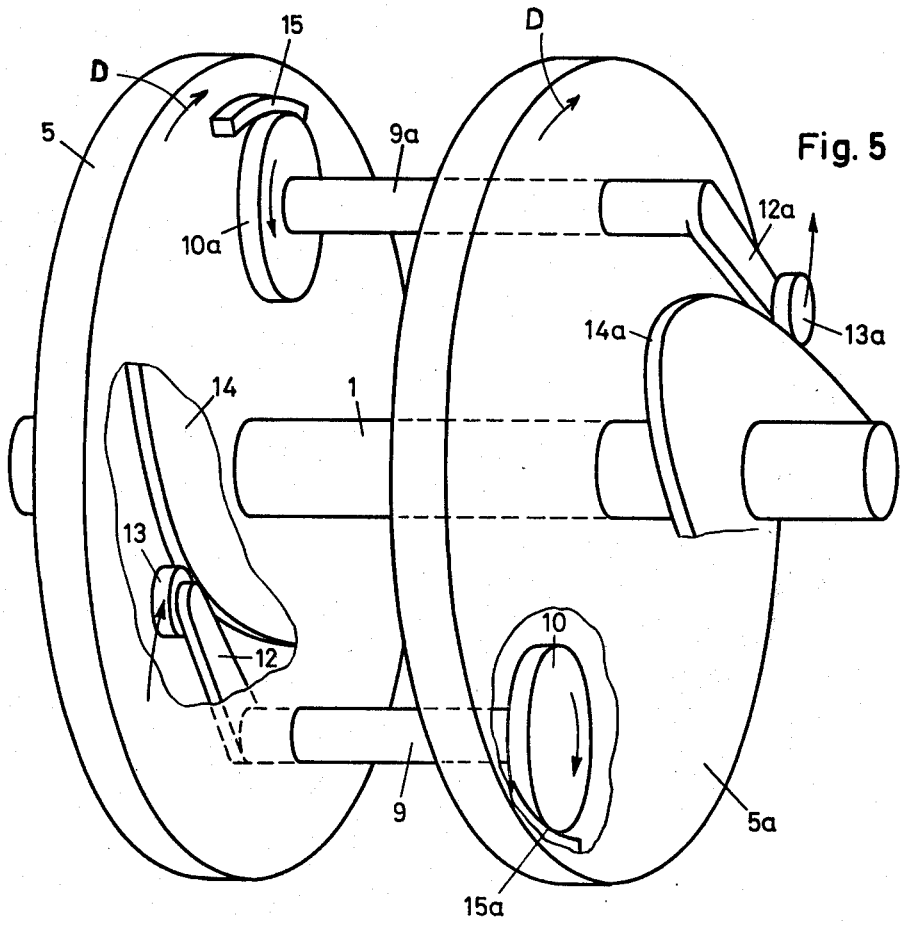
FIG. 5 is a schematic, perspective view of the two supporting disks and related cams, shafts, and gears which comprise a mechanically closed system for corotation and swivelling of disks.

The axial connector gears 11, 11a engage the axial gears 7, 7a, respectively. The inner connector gears 10, 10a each engage an inner gear segment or ring 15a or 15, respectively, carried on the oppositely disposed disk 5a or 5, respectively. The disks 5, 5a are thus connected through the connector gear assemblies 8, 8a to the opposite axial gears 7a, 7. Upon rotation of the disks 5, 5a a cyclical swinging of the connector gear assemblies 8, 8a occurs about the axle journals 9, 9a, respectively, due to the radial rising and falling of the surfaces of the cams 14, 14a with respect to the axis of the machine shaft 1. As shown in the schematic diagram of FIG. 5, the carrier disks 5, 5a form a mechanically closed system with the cooperating cams 14, 14a, the shafts 9, 9a, and the gears 10,15a; 10a, 15. For clarity, the disks 5, 5a are spaced apart in FIG. 5, and some gear parts are omitted. In the operating position shown, during rotation in direction D, the cam lever 12a is thrust radially outwardly by the cam 14a. Simultaneously, cam lever 12 is moved inwardly along its cam 14. Both cam levers 12, 12a thus move simultaneously in precisely controlled angular displacements. Radii of the connecting gears and related gears used in a prototype embodiment as shown in FIG. 6 are:

| | |
|---|---|
| Inner connector gears 10, 10a | $R_1$ = 30 mm |
| Axial Connector gears 11, 11a | $R_2$ = 50 mm |
| Axial gears 7, 7a | $R_3$ = 40 mm |
| Inner gear segments 15, 15a | $R_4$ = 120 mm |

The rotating disks 5, 5a have circumferential drive gear segments 17, 17a, respectively, which sequentially and alternately engage a driven shaft 16 journalled in the housing via driven gear wheels 18, 18a fixed on the driven shaft 16. The cams 14, 14a and the connecting gear assemblies 8, 8a bring the gear segments 17, 17a of the disks 5, 5a smoothly into and out of engagement with the driven gear wheels 18, 18a during a synchronous-rotation portion of the disk' movement.

Compressed air in this compressed air motor embodiment is controlled by two roller valves 19 fixed on the disk 5a for rotation therewith and closely adjacent the cylinders 2a, 3a. The valves 19 have negligible mechanical losses and require no cam shafts or springs. The roller valves 19 are driven through a gear wheel 20 fixed in the housing H about the shaft 1, a pair of intermediate idler wheels 22 carried on a holding member 21 on the disk 5a, and roller valve drive wheels 23. The gear ratio provides that for each revolution of the disk 5 or 5a, each roller valve 19 undergoes a half-revolution. Depending on the construction, other gear ratios and gear arrangements may be employed.

Compressed air for driving the machine is supplied through the central bore 38 past an O-ring seal (not shown), through a wheel corotating with disk 5a, and through conduits 38a to the roller valves 19. Air is conveyed through the valves 19 and bores 19a therein and air lines 39 into the cylinders 2a, 3a at ports 54. Valve bores 19b pass exhaust air from the cylinders to atmosphere.

Each piston and cylinder 2, 3; 2a, 3a of the machine is closed at one end and clamped in a two-part holding member 24 or 24a, respectively, as shown in the figures. The cylinder holding members 24a are mounted on the outer periphery of the disk 5a, and the piston holding members 24 on the periphery of the disk 5.

Proper treatment and sealing of the curved cylinders and pistons is prerequisite to efficient operation of the machine. The inner surface of the curved cylinders 2a, 3a being impossible to hone, instead the outer surfaces of the pistons 2, 3 are honed. Seal means are applied to the cylinder mouths in a novel manner. Each cylinder 2a, 3a has adjacent its opening or mouth an annular chamber 25 in which is disposed a sealing O-ring 26 and a slide-ring 27 each made of plastic or synthetic material and pressed onto the piston sleeve. The sealing ring 26 is pressed during operation onto the honed surface of the piston by pressure in the cylinder about the piston. No disadvantageous pulsing or whirling of rings in piston grooves as in known piston engines occurs with this embodiment. Only a single sealing ring 26 is required.

For emergency stroke limitation a pin 28 is arranged on one supporting disk 5a to engage an arcuately shaped groove 29 formed in the other supporting disk 5. The curve length of the groove 29 corresponds to the piston stroke. Since the piston stroke is normally defined by the machine drive gear and cams, the pin 28 and the groove 29 serve solely as fail-safe devices.

Bearing support sleeves 30 for the connecting gear shafts 9, 9a are pressed into corresponding bores 31 in the disks 5, 5a and receive needle bearings 32 carrying the gear shafts 9, 9a.

The disks 5, 5a are supported radially about the hubs 6, 6a by needle bearings 33 and axially of the machine by needle supports 34. The bearings 33, 34 are spaced apart on each disk 5, 5a by a sleeve 35 and are pretensioned by an outside ring 36 secured to each hub 6, 6a, and a central ring 37 likewise fixed to each hub.

A. Relations Among Parts of the Compressed Air Machine

The relative movement of the pistons 2, 3 and cylinders 2a, 3a is controlled through the cam rollers 13, 13a and the cam levers 12, 12a in cooperation with the cams 14, 14a. The cam lever 12 is interconnected mechanically with lever 12a in one direction through shaft 9, the inner connector gear 10, the inner gear segment 15a, and through the disk 5a carrying the gear shaft 9a, and in the opposite direction by corresponding parts 10a, 15, and 5. The surface portions of the cams 14, 14a control the relative swinging movement of the disks 5, 5a and the starting and stopping of the hubs 6, 6a and the axial gears 7, 7a thereon. The swivel strokes of connector gear shafts 9, 9a are determined by the radial raising and lowering parts of the cams 14, 14a, proceeding in the rotation direction. The two cams generally cooperate with one another so that the cam lever wheel 13 or 13a running on a control portion of one cam 14, 14a prevents lifting of the opposite cam lever 13a or 13 running on a counter-cam portion of the other cam 14a, 14 through the mechanical connection noted above. FIG. 7 illustrates some of the working relationships including rotation phases B, S, V, and G for the disk meshing with the driven gear wheels 18, 18a and B', V', S', and G for the free-moving disk, for substantially one-half a revolution of the disks 5, 5a or one stroke of the machine.

During each revolution of the disks 5, 5a each piston-cylinder unit of the compressed air motor undergoes one expansion stroke and one exhaust stroke. When the drive gear segment 17 of the disk 5 is engaged with the drive gear wheel 18 and piston 2 moves to expand the gas in the cylinder 2a, the cam roller 13 during a first rotation phase B runs radially inwardly along the cam 14 toward the shaft 1 to exert a reverse-direction rotating force via the axial connector gear 11 onto the axial gear 7 to slow and stop rotation of the gear 7. The radially outwardly proceeding section B' accelerates the non-engaged disk 5a. During the second phase S the gear 7 is locked, the connector gear 11 rotates along the periphery thereof, and the disks rotate at constant but different speeds. During the third, retardation phase V the cam 14 and cam follower 13 allow the axial gear 7 to resume rotation, while the phase V' allows the disk 5a to slow down once again. At the ends of the locking phase S the axial gear 7 comes smoothly and without impact into and out of its locked condition.

Substantially no load is imposed on cam 14 by the cam roller 13 during the B, S, and V phases, and a weight saving can be effected by recessing the cams 14, 14a over their S phase. Corresponding sections on the other cam 14a engaged by the roller 13a on the disk 5a during the B', S', and V' phases prevent lifting of the first cam roller 13 from the cam 14 through the connecting gears 8, 8a during the swinging ahead of the disk 5a. That is, the cam roller 13a rides radially outwardly from the main shaft 1 along the cam 14a, tending to move the drive gear segment 15 in a reverse direction via the engagement of the inner connection gear 10a. However, the drive linkages and high-pressure air in the cylinder 2 force the disk 5a forwardly relative to the disk 5 under the reaction of gases on the piston 2 and the cylinder 2a. Thus, the mechanical circuit is closed over each full revolution of the piston machine. Work is put out twice over arcs of 80°, corresponding to the S phase of each disk 5, 5a.

FIGS. 4a, 4b, 5–6, 7, and 7a–f illustrate detailed kinematics of the new piston machine in the compressed air motor embodiment.

Figure 4A:
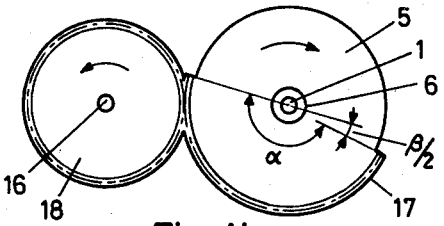
Figure 4B:
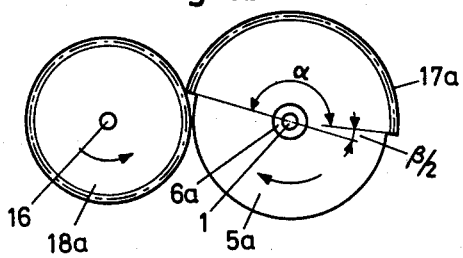

In FIG. 4a, the disk 5 supported on the hub 6 is shown diagrammatically with its drive gear segment 17 meshing with the driven gear wheel 18. The length of the drive gear segment 17 is smaller than 180°, but extends at least through a meshing angle $\alpha$ as shown. During the meshing of the piston disk 5 with its driven gear wheel 18, the gear segment 17a of the disk 5a is out of engagement with the driven gear wheel 18a, as in FIG. 4b. The disk 5a undergoes a larger revolution through the angle $\alpha + \beta$, the angle $\beta$ corresponding to the piston stroke for moving the cylinders 2a, 3a forwardly or ahead of the pistons 2, 3. The drive gear segments 17, 17a accordingly each extend at least through an angle of $\alpha = 180° - \beta/2$. In a prototype machine, the stroke angle $\beta$ is 21.6°, so the angle $\alpha$ amounts to 169.2°. To insure a momentary overlapping engagement, each gear segment arc $\alpha$ is increased by a short section over $(180° - \beta/2)$.

Each disk 5, 5a rotates at a constant speed during meshing with its corresponding gear wheel 18, 18a, while the other disk 5a, 5, not in engagement, swivels ahead. Over a revolution of 360°, the disks make the following corresponding movements:

| | |
|---|---|
| Disk 5 : | $\alpha + (\alpha + \beta) = 360°$ |
| Disk 5a : | $(\alpha + \beta) + \alpha = 360°$ |

The movements of the disks 5, 5a respectively engaging the driven gear wheel 18 or 18a and swiveling ahead, and the movements of related control components, are divided kinematically into the following sections:

| Rotation Segments | Meshing Disk 5 or 5a | Non-Meshing Disk 5a or 5 |
|---|---|---|
| 1. Non-meshing disk 5a or 5 accelerates; axial gear 7, 7a slows and stops | B = 28° | B' = 28.0° + 2.8° = 30.8 |
| 2. Non-meshing disk 5a, 5 rotates at constant increased speed; axial gear 7, 7a is locked; meshing disk 5, 5a drives the shaft 16, 16a | S = 80.0° | S' = 80.0 + 16.0° = 96.0° |
| 3. Non-meshing disk 5a, 5 decelerates; axial gear 7,7a accelerates | V = 28° | V' = 28° + 2.8° = 30.8° |
| 4. All parts rotate synchronously at constant speed to exchange engagement of output gear segments 17, 17a with driven gear wheels 18, 18a | G = 33.2° | G = 33.2° |

$\alpha = 169.2°$ $\alpha + \beta = 169.2° + 21.6° = 190.8°$

As previously, $\alpha + (\alpha + \beta) = 169.2° + 190.8° = 360°$.

In FIGS. 7–7f the interrelationships between the rotational movement and the superimposed relative swinging of the disks 5, 5a are schematically represented over a rotational angle of 169.2° of the disk 5. Such rotation angle is undergone by the meshing disk 5 with a uniform rotational speed; it corresponds to the partial stretches B + S + V + G. In the figures the additional swinging of the non-meshing disk 5a is shown for various intermediate rotational angles.

In FIG. 7 the end of the uniform or synchronous run G, and the beginning of the acceleration B is selected as a rotational angle of zero degrees. Then, at a rotational angle of 14°, FIG. 7a shows the middle of the acceleration stretch B. At a rotational angle of 28°, FIG. 7b shows the end of the acceleration B and the beginning of the locking run S. Subsequently, at a rotational angle of 108°, FIG. 7*c* shows the end of the locking run S and the beginning of the retardation stretch V. At a rotational angle of 122°, FIG. 7*d* corresponds to the middle of the retardation stretch V. The end of the retardation stretch V and the beginning of the synchronous run G at 136° is shown in the diagram in FIG. 7*e*. Finally, FIG. 7*f* represents the end of the synchronous run G at 169.2°.

With the carrier disks 5, 5*a* having 94 teeth 15 at a pitch of 1.8° each (94 × 1.80° = 169.2°), a relative swinging of the carrier disks 5, 5*a* of 1° causes a swinging of the connector gear wheels 10, 11; 10*a*, 11*a* as well as of the cam levers 12, 12*a* of 4°, since the gear transmission ratio 15: 10*a* is 1:4. In addition, a rotation of the axial gear 7 of 5° is brought about, since the corresponding gear ratio 15: 11*a* is 1:5.

Thus, the following movement ratios necessarily result:

| Drawing Figure | Phase(s) | Rotational Angle of meshing disk 5, 5a with respect to shaft 1, during half rotation of non-meshing disk 5a, 5. | Cumulative additional relative swinging of non-meshing disk 5a, 5 in relation to meshing disk 5, 5a. |
|---|---|---|---|
| 7 | G-B | 0° | 0° |
| 7a | B | 14° | 0.7 |
| 7b | B-S | 28° | 2.8° |
| 7c | S-V | 108° | 18.8° |
| 7d | V | 122° | 20.9° |
| 7e | V-G | 136° | 21.6° |
| 7f | G-B | 169.2° | 21.6° |

| Drawing Figure | Phase(s) | Cumulative additional relative swinging of connector gears 10, 11; 10a, 11a and of cam levers 12, 12a in relation to axle shafts 9, 9a. | Rotation of axial gears 7, 7a in relation to axle 1. |
|---|---|---|---|
| 7 | G-B | 0° | 0° |
| 7a | B | 2.8° | 3.5° |
| 7b | B-S | 11.2° | 14° |
| 7c | S-V | 75.2° | 94° |
| 7d | V | 83.6° | 104.5° |
| 7e | V-G | 86.4° | 108° |
| 7f | G-B | 86.4° | 108° |

During the synchronous run phase G, corresponding to a rotational angle of 136° to 169.2°, all elements move uniformly. At the end of the synchronous phase the previously meshing disk 5 exchanges with the previously non-meshing disk 5*a*, whereupon all functions of the two disks are switched and the process begins anew.

In order words, the disk 5*a* swivels 18.8° with respect to disk 5 while the gear 7 is locked, due to the 94° stroke of the axial connector gear 11 past the gear 7 and the 1:5 gear ratio. Co-movement of axial gear 7 with the axial connector gear 11 during the 14° B stretch and the 14° V stretch of the disk 5*a* increases the total angle of swing of the disk 5*a* with respect to disk 5 by 2.8° to 21.6° total over the B, S and V stretches. A further, synchronous stretch G occurs during which the disks 5, 5*a* move through an angle of 33.2° with no relative swinging and the connector gear shafts 9, 9*a* do not rotate relative to their respective disks.

Disengagement of the drive gear segment 17 from the driven gear wheel 18 occurs during the synchronous stretch simultaneously with or shortly after engagement of the drive gear segment 17*a* of the cylinder-carrying disk 5*a* with the wheel 18*a*. During approximately the next half-cycle of the machine, the disk 5 is swung forwardly with respect to the disk 5*a* by expansion of gas within the cylinder 3*a* and driving of the gear 18*a* via the drive gear segment 17*a* on the cylinder-carrying disk 5*a*.

B. Modifications to the Compressed Air Machine

The piston machine described in the foregoing is a prototype which is not developed optimally for production. Thus, for savings of weight, instead of using supporting disks 5, 5*a*, individual supporting arms could be provided to support pistons and cylinders on the ends thereof and also related components. Also,, the gears of the connector assemblies 8, 8*a* could be constructed as toothed segments, since during the rotation they swing but do not fully rotate with respect to the supporting disks 5, 5*a*. The axial gears 7, 7*a* may also be replaced by short tooth segments.

Further, the cams 14, 14*a* are identical in shape and in orientation in the housing H with one another. It would therefore be possible to use only one cam to control both levers 12, 12*a*, particularly due to the limited relative swinging of the disks 5, 5*a*. However, the embodiment with two cams is simpler structurally. Further, the nonload-bearing portions S of the two cams 14, 14*a* may be dispensed with, as in the solid line of FIG. 7, for weight savings, although the cam followers will trace the broken-line path.

To improve the mechanical efficiency of the piston machine, four or more groups of pistons and cylinders could be arranged over the periphery of the two disks 5, 5*a*. Also, several pairs of disks could be arranged along the machine shaft 1 axially adjacent one another, or be disposed opposite one another about and symmetrically to the driven shaft 16. With a phase-coordinated interaction among such engines, the system need never have a dead spot. In other embodiments of the compressed air machine using more than two pistons, each disk or arm could support the pistons of one piston-cylinder group and the cylinders of another group, although the supply of compressed air would be somewhat more complicated in being provided from both sides of the machine.

C. Operation of the Compressed Air Motor

During each revolution of the disks 5, 5*a*, each piston 2, 3 acted on by compressed air fed through the valves 19 carries out one operating and one ejection stroke. During the operating or expansion stroke of the first piston 2, its disk 5 is supported through the hub 6 and the machine shaft 1 on the housing H. The disk 5*a* and cylinder 2*a* undergo an additional angular movement corresponding to the length of the stroke of the piston 2. Simultaneously, the second cylinder 3*a* on the swiveling disk 5a is pushed onto the second piston 3 on the disk 5. Thus, while the first piston 2 carries out its operating stroke, the second piston carries out its ejection stroke. On the other half of each revolution the disk 5 swivels ahead while the gear segment 17a of the disk 5a is engaged with the driven wheel 18a at constant speed. The piston 3 then advances ahead of the cylinder 3a, under the force of expansion of gas therein while the piston 2 advances into the cylinder 2a to expel gas therefrom.

On each synchronous stretch G, G, both disks 5, 5a rotate at the same, constant rate of rotation since the cam rollers 13, 13a engage sections of the cams 14, 14a which are circular about the machine shaft 1. At ends of one stretch G the disk 5 is brought smoothly into engagement with driven gear wheel 18, while the other disk 5a comes out of engagement. On the following acceleration stretch, the non-mating disk 5a is accelerated with respect to the mating disk 5. The hub 6 and axial gear 7 thereon are gently locked. Then the mating disk 5 rotates during the locking stretch S on its locked hub 6. Power is transferred to the drive gear wheel 18 during this stretch S. During this time, the non-mating disk 5a swivels further forward on the corresponding stretch S' with its somewhat higher rate of rotation. The retardation stretches V, V' follow, wherein the non-mating disk 5a is retarded to the rate of rotation of the disk 5 and the hub 6 and axial gear 7 is unlocked and allowed to rotate. Then both disks 5, 5a run synchronously over the other stretch G, whereby the disk 5 comes out of engagement, and the other disk 5a comes into engagement with the wheels 18, 18a via the drive gear segments 17, 17a. On the other half revolution, the parts reverse their functions.

In FIG. 6 the gear connection between the connecting gear assembly 8a and the two disks 5 and 5a is shown diagrammatically. The assembly 8a is swingable about its axle journal 9a in the disk 5a, and engages by its axial connector gear 11a with the axial gear 7a and by its inner connector gear 10a with the toothed ring 15 of the disk 5. The operating cylinder drives disk 5a via the locked axial gear 7a for rotation in the direction of rotation D of the disks 5, 5a. The disk 5 pushes off from the housing via the locked axial gear 7a, whereby simultaneously on account of the swinging or shifting of the gearing part 8a effected through the cam lever 12a, the two disks 5, 5a during the rotation likewise swivel with respect to one another. This relative movement of the two disks, geometrically a shifting to and fro, or advancement of one disk with respect to the other, has only small inertia forces in the mechanism to overcome.

The operating sequence takes place symmetrically, interchangeably, and to a large extent free from vibration. Depending on the specific system, as where a locking stretch of at least 80° and a piston stroke of 21.6° are used, the motor never has a mechanical locking point.

II. Hot Air Motor

In a second embodiment of the piston machine, as shown in FIGS. 8 and 9, the machine is driven with hot gas developed by continuous external combustion therein. The kinematic mechanism remains basically unchanged. The piston and cylinder unit 2, 2a however serves as a compressor or a condenser unit, and the second piston and cylinder 3, 3a as an operating or power unit. The previous operating, expansion stroke of the piston 2 becomes a suction stroke, and the exhaust stroke of the piston 2 becomes a compression stroke. The piston 3 undergoes expansion and exhaust strokes as in the compressed air machine.

During each suction stroke of the piston 2, air enters directly from atmosphere through a one-way suction valve 40 in the head of the piston and into a cylinder chamber 41. The cylinder chamber 41 communicates via a conduit 42 to a co-rotating air container 43. Upon the compression stroke, air in chamber 41 is forced into the container 43. A one-way check valve 44 in the conduit 42 prevents backflow of air into the cylinder 41.

The volume of the air container 43 is a sufficient multiple of the piston displacement that air outlet temperature at conduit 45 will approach ambient temperature. Heat loss is facilitated by the rotation of the container and construction of the walls thereof with a highly heat-conductive material. The cooled, compressed air in the container 43 passes through conduit 45 and a first port 19c of roller valve 19 into an unheated first chamber 48 of an air heater 46. A second check valve 47 downstream from the valve 19 prevents any return flow of air and closes off the air heater 46 both before the air therein can be heated and also before the roller valve 19 is completely closed. The air heater 46 is fixed on and rotates with the disk 5a.

A mechanically controlled displacing member 49 moves reciprocally in the air heater 46 to drive air from the cold chamber 48 into a hot chamber 51 of the heater 46. The air passes through a narrow, annular gap 50 between the member 49 and an inner wall of the air heater 46. It passes with great turbulence into the hot chamber 51 to contact a heater element 52 in which a combustible fuel-air mixture supplied through a conduit 53 is continuously burned.

The air heater 46 is fixed adjacent the operating cylinder 3a on the supporting disk 5a, so that the heated air passes directly into the operating cylinder 3a, through short conduits 67 and 54 substantially without loss of temperature or pressure.

A heater disk 64 heated by means of the heater element 52 preferably has a temperature over 1000° C. With suitable construction, the air in the heater disk 64 may be heated by three or four times its absolute starting temperature, to about 1400° K. from about 350° K. Such heating provides a high thermal efficiency by analogy to the Carnot engine formula:

$$\frac{1400^\circ K - 350^\circ K}{1400^\circ K} = 0.75 = 75\%$$

The piston 3 in the operating cylinder 3a is moved in a stroke to the right in FIG. 8 under pressure of the hot, expanding gas, just as in the compressed air motor. When the piston stroke ends, the displacement member 49 is returned to its starting position and the outlet port 19d of the roller valve 19 is mechanically opened. The expanded hot air in the cylinder 3a is driven by the leftward-moving piston 3 into a co-rotating expansion chamber of air vessel 155. The air passing into the expansion chamber 55 is still hot and is therefore advantageously mixed, via the connection line 53a, with the combustible gas in the conduit 53 to preheat the gas mixture for ignition in the heater element 52.

By the continuous combustion in the heater 52 a high flame temperature and a stoichiometrically thorough combustion are obtained. The exhaust gases, containing only slight quantities of noxious substances, are passed to atmosphere through line 69.

Compression of the air in cylinder 2a takes place with only minor mechanical losses. The operating pressure in the cylinder 3a depends upon the increase of pressure by the heating of the air. Due to the continuous external combustion the expansion of the gas takes place isothermally, and most of the heat of combustion is passed to the co-rotating air vessel 55.

In FIG. 9 the air heater 46 is shown in detailed longitudinal section. The condensed air from the inlet conduit 45 passes through the check valve 47 into the cold chamber 48 of the air heater. The displacement member 49 is guided in a chamber bushing 56 via a piston rod 57 positioned reciprocally in a closure cover 58 and in a supporting bearing 59. An O-ring 60 seals the rod 57 in the cover 58.

Reciprocal movement of the displacer member 49 in one embodiment has been created by a gear on the piston rod 57 engaged by a further gear on one of the cam disks. It is preferred, however, to eliminate the mechanical drive of the displacer member 49 by suitable design and timing of the roller valve 19. While the control bore 19d connects the outlet from the heater 46 and cylinder 54 (approximately at the middle of the synchronous run G), the inlet to the heater 46 is already opened by the control bore 19c. The compressed cold air flows via the check valve 47 into the cold chamber 48 and presses the displacer 49 against the heater element 64. So that no counterpressure can build up as a consequence of the different opposing displacer piston surface areas, the outlet bore 19d remains open until the displacer piston 49 has contacted the heater disk 64.

The control bore 19d next closes the heater/cylinder outlet. The counterpressure building up in the space 51 as a consequence of the heating of the heater disk causes the displacer 49 to be thrust back powerfully. As a consequence, the cold air flows with great speed through the air gap 50, along the inner bushing 56 and against the heater disk 64. The ensuing turbulence promotes swift heating of the cold, compressed air.

With proper embodiment of the gas heater with a large heating surface and a short displacer movement, a high thermal efficiency can be achieved.

The heater element 52, as shown in FIG. 9, has a semi-circularly-shaped combustion chamber 65 and a combustion nozzle 66 projecting thereinto. The combustible gases from conduits 53 are directed onto the heater disk 64, which thereby attains very high temperatures. Heated air leaves the air heater through an outlet conduit 67 and passes to the operating cylinder 3a.

Sealing of the closure cover 58 and the heater disk 64 to the housing 68 of the air heater assembly 46 is accomplished by "Kaowool" or similar seals or packings.

The air heater 46, the air container 43 and the expansion chamber of air vessel 55 are affixed to the supporting disk 5a, with the cylinders 2a and 3a, so that the connecting conduits among the parts can be short to keep pressure losses to a minimum.

The air in the expansion chamber 55 has a temperature of, for example, about 200° C. Since this energy is used for the preheating of the combustible mixture and is not entirely lost, the thermal efficiency of the system approaches closely the efficiency of the Carnot process.

In the hot air combustion engines of FIGS. 8–9, the relative swinging movements of the disks 5, 5a are caused by gas pressure in the cylinder 3a reacting to create rotational drive forces through the axial gears 7, 7a. The cams 14, 14a have a control function only and are lightly stressed mechanically. During the locking phase S, which extends over 80°, the machine constructed as a combustion engine yields work via the disk 5a which drives its respective gear wheel 18a during the expansion stroke of the piston 3. The gas pressure in the cylinder 3a is thereby used by the motor with a full, constant twisting moment about the shaft 1.

In another embodiment of a hot air engine, shown partly schematically in FIG. 10, air is pressurized not in one of the piston/cylinder groups but in a separate compressor and is conveyed into a stationary air container 143. From there, the air passes via a line 45a and the bore 38 in the main shaft 1 of the machine into inlet line 45, as shown in FIG. 10. In the Figure the arrangement of the roller valve 19 and of one air heater 46 on the carrier disk 5 is depicted. The second piston/cylinder group with its associated air heater is left out for clarity. The other design elements correspond to those of FIGS. 8 and 9.

III. Air Compressor

A piston machine to be used only as a compressor can be substantially simplified in comparison to the motor embodiments, requiring neither the axial gears 7, 7a nor the roller valves 19. FIGS. 11 to 16 show such a compressor embodiment of a piston machine with pistons and cylinders revolving on a circular path. Where the parts are the same as the parts of the previously described motor embodiments identical reference numerals are used.

The piston machine depicted in the drawings is driven by the output shaft 16 of a drive unit. This drive unit could, for example, be the hot gas engine of FIG. 10.

The compressor machine of FIGS. 11–16 has two pistons 2, 3 and cylinders 2a, 3a revolving around a machine shaft 1 fixed to the housing H. The pistons and cylinders are arcuately curved and have axes lying on a circle 4. The two piston/cylinder groups 2, 2a and 3,3a are attached on the periphery of a pair of disks 5, 5a freely mounted rotatably on the machine shaft 1. One carrier disk 5 carries the two pistons 2, 3 and the other carrier disk 5a carries the cylinders 2a, 3a thereon. During each full rotation of the disks, the pistons 2, 3 each carry out an intake and a compression stroke upon a cyclical relative swinging of the disks 5, 5a superimposed on the rotation.

The swinging movement of the disks is controlled by a gear train comprising two connector gear assemblies 8, 8a, a control cam and a counter cam associated therewith, and cam followers 12, 13; 12a, 13a.

Each connector gear assembly 8, 8a has an axle 9 or 9a mounted in disk 5 or 5a. Each axle 9, 9a carries a connector gear 10 or 10a between the disks 5, 5a and a cam lever 12 or 12a affixed to the outer end. Each cam lever 12, 12a rotatably carries a cam wheel 13 or 13a, which runs on the cam disk 14 or 14a fixed to the housing. The cam wheels 13, 13a and cams 14, 14a cause a cyclical swinging of the connector gear 8, 8a around their axles 9, 9a during rotation of the disks 5, 5a.

Connector gears 10, 10a of connector gear assemblies 8, 8a engage inner gear segments or rings 15a, 15, respectively, carried on the disk 5a or 5 opposite thereto.

Disks 5, 5a are thus connected together in a force locking way via cams 14, 14a. The relative swinging motions of disks 5, 5a, corresponding to the piston strokes, are caused by the cams 14, 14a and the associated followers 12, 12a; 13, 13a. Gear parts 8, 8a also carry out corresponding swing movements around their axles 9, 9a.

The drive power is transmitted from drive shaft 16 sequentially onto each of the rotating disks 5, 5a. Each disk 5, 5a has an outer circumferential drive gear segment 17 or 17a which extends over a part of each disk circumference.

During the synchronous run phase of rotation of the disks 5, 5a, the drive gear segments 17, 17a are in alternating engagement with corresponding driven gear wheels 18, 18a attached on the drive shaft 16. The cams 14, 14a and connector gear assemblies 8, 8a assure that the disks 5, 5a coming respectively into engagement will rotate synchronously with their driven gear wheels 18, 18a.

Although geometrically a reciprocal shifting, the relative movements of the two disks comprise alternating advancing and retarding movements with respect to the housing H, so that only limited inertial effects arise.

To prevent lifting of either cam roller 13, 13a one section on each cam 14, 14a is embodied as a "counter cam". That is, the running of one cam roller on the "counter curve" of its cam prevents, via the connector gearing, a lifting up of the other cam roller. The sequence takes place symmetrically, alternately, and largely without vibration.

For an explanation of these relationships attention is called to FIG. 15.

The shifting movement sequence in the compressor machine is controlled by the cam levers 12, 12a and cam rollers 13, 13a running on the cam disks 14, 14a, the cam levers being mechanically connected to one another via the connector gearing. Stroke limitations of the piston/-cylinder units 2, 2a; 3, 3a are defined by the control cam and the counter cam portions of the cam disks 14, 14a, by the radially raised and lowered parts thereof. In addition, the two cams act together with each other in such a way that the cam lever running on the respective control cam portion of the one cam disk prevents lifting of the cam lever running on the counter cam portion of the other cam disk, and vice versa. For a better understanding of this interrelationship the radially raised and lowered parts of the cams are shown at the same rotary positions in solid lines or in dotted lines in FIG. 15. Accordingly, each cam has a section with a control cam and a section with a counter cam, which sections are in a reciprocal relationship with one another. See also FIG. 5.

The machining or processing of the curved cylinders and pistons for sealing thereof, as a prerequisite to correct and economical functioning, has been described above in section I, as well as the control of the rotation as a necessary guarantee of a closed mechanical sequence.

Gas exchange in the cylinders is depicted in FIG. 16. Atmospheric air, filtered in any convenient manner, is drawn in through rotating compressor piston 2 via its valve 40, and is compressed in cylinder 2a.

When the compressor piston 2 returns leftwardly in FIG. 16, to expand the volume 41 in cylinder 2a above the piston 2, an underpressure is created there. The intake valve 40 opens due to the pressure differential and permits atmospheric air to flow though the hollow piston 2 and into the increasing volume 41 above the piston 2. The valve closes when approximate pressure equalization has been achieved at the end of the suction stroke.

During the compression stroke the one-way intake valve 40 of piston 2 is closed. The air in the space 41 is compressed and passes via a further one-way valve 44 into a cooling coil or spiral tube 75 as soon as the pressure in the compressor cylinder 2 is at least as high as in the coil 75. The compressed air is expelled directly into the coil 75 without lost volume. The cooling coil spiral 75 is connected, via a retaining ring 76, to the bore 38 of the fixed, hollow shaft 1 of the housing. From the hollow shaft 1, the air is conveyed via a line 74 into a stationary pressure chamber 78. A further one-way valve 79 controls output from the chamber 78.

Thus compression of the air as an operating medium occurs with only slight mechanical losses.

In an advantageous combined embodiment of the invention a piston machine compressor is connected in front of a piston machine hot gas engine. In this combination, which is not more specifically represented, the pressurized or supercharged air passes from the pressure chamber 78 or 143 via the hollow shaft 1 of the hot gas engine to its two co-rotating air heaters and, from there, into the two piston-cylinder drive units. The control of the air in the hot gas engine is accomplished by means of the roller valves. The compressor is coupled directly to the hot gas engine, so that a part of the power developed in the engine is used to drive the compressor.

Although various minor modifications may be suggested by those versed in the art, I do embody within the scope of the patent warranted hereon all such modifications as reasonably and properly come within the scope of my contribution to the art.

I claim as my invention:

1. A piston machine comprising:

first and second supporting parts mounted for rotation about a common axis and for pivotal movement with respect to one another about said axis;

a piston mounted on the first part spaced from said axis;

a cylinder mounted on said second part, slidably receiving the piston, and similarly spaced from said axis for relative reciprocal movement with the relative pivotal movement of the supporting parts;

cam means fixed about said axis;

cam follower and connector gear means carried swivelably on each of said supporting parts for cooperatively engaging said cam means and an opposite one of the supporting parts for controlling the relative pivotal positions of the supporting parts during 360° of rotation;

valve means for controllably passing a compressible fluid to and from the cylinder;

first and second segment gears respectively carried by said first and second parts; and a power shaft having a pinion means engageable sequentially with each of said segment gears.

2. A piston machine comprising:

at least one arcuately shaped, curved piston and a cylinder cooperating therewith rotating on a circular path about a fixed shaft of said machine;

a pair of co-rotating supporting parts, each carrying one of said piston and cylinder and being swivelable with respect to one another;

a driven shaft engageable sequentially with each of said supporting parts by a gear means carried on said shaft and said parts;

a pair of connector gear assemblies each carried swivelably on a shaft in each of said supporting parts offset from and arranged parallel to the fixed shaft, and carrying on a first axial end thereof an inner connector gear engaging the opposite supporting part and on an opposite axial end thereof a cam follower lever;

at least one cam fixed about said fixed shaft axially adjacent said supporting parts and engageable with the cam follower levers of the connector gear assemblies; and valve means adjacent said cylinder for selectively passing a compressible working fluid to and from said cylinder, whereby the connector gear assemblies and cam control the relative swiveling movement of the supporting parts for working by the piston and cylinder with said compressible fluid.

3. A piston machine as defined in claim 2, further comprising:

an axial connector gear on the first axial end of each connector gear shaft; and a pair of axial gears mounted axially adjacent one another about said fixed shaft, each engaging one of said axial connector gears, and each being carried on a unidirectional clutch means for free rotation with a respective one of the supporting parts but for locking against rotation in a direction opposite to that of said respective supporting parts.

4. A piston machine as defined in claim 2, wherein said gear means comprises a pair of axially spaced-apart driven gear wheels on said driven shaft, a pair of drive gear segments arranged on an outer circumference of said supporting parts for sequential engagement of only one and then only the other of said drive gear segments with said driven gear wheels except only for momentary simultaneous engagement upon each exchange of engagement.

5. A piston machine as defined in claim 4, wherein each gear drive segment extends through an arc of $\alpha$ degrees about the outer circumference of its respective supporting parts and measures at least $(180-\beta/2)°$, where $\beta$ is an angle of stroke of the piston with respect to the cylinder.

6. A piston machine as defined in claim 2, wherein the supporting parts comprise a pair of disks, and wherein a periphery of one of said disks carries said piston and a periphery of the other disk carries said cylinder.

7. A piston machine as defined in claim 2, wherein each piston and each cylinder is a cylindrical-walled tube bent axially to the perimeter of a circle and each piston is honed on its exterior surface.

8. A piston machine as defined in claim 7, further comprising a piston sealing means adjacent a mouth opening of said cylinder, said sealing means being engageable with said honed surface of said piston cooperable therewith.

9. A piston machine as defined in claim 8, wherein said sealing means comprises an annular chamber in which is fitted a sealing ring engageable about said piston surface.

10. A piston machine as defined in claim 9, wherein said annular chamber is also fitted with a slide ring bearing upon said piston surface.

11. A piston machine as defined in claim 2, wherein said cam has surface means which, when engaged by the cam follower levers, guides the supporting part not engaged with the drive shaft through sequential acceleration, increased speed, retardation, and synchronous speed stretches with respect to the supporting part engaged with the drive shaft on each half revolution of the supporting parts.

12. A piston machine as defined in claim 2, wherein the valve means comprises a roller valve carried on the cylinder-carrying supporting part, having a rotatable bore portion, and driven by valve gear means proportionally to each full revolution of the supporting parts.

13. A piston machine as defined in claim 12, wherein the roller valve gear means comprises a gear fixed coaxially to said fixed shaft, an idler gear carried on said cylinder-carrying supporting part, and a valve gear carried on said rotatable bore portion of said valve.

14. A piston machine as defined in claim 13, wherein the bore portion of said valve is rotated through one-half revolution for each full revolution of the supporting part.

15. A piston machine as defined in claim 2, wherein the compressible working fluid is compressed air supplied from a source outside said machine.

16. A piston machine as defined in claim 2, wherein the compressible working fluid is air and the machine further comprises:

a first piston-cylinder unit having means to draw air from atmosphere and to compress it;

a heater means for receiving air from said first compressor unit and for heating said air to an elevated temperature in a confined space;

check valve means blocking a return flow of air to said unit from said heater means;

a second piston-cylinder unit having means for expanding the air from said heater to produce work to drive the drive shaft and the first unit; and passage and valve means for selectively exhausting expanded air from said second unit.

17. A piston machine as defined in claim 16, wherein said heater means comprises a cylinder having an axially-displaceable, non-circumferentially sealed displacement member means reciprocable therein for turbulently passing air from a cold portion of said heater means to a portion thereof containing a heated surface contactable by said air.

18. A piston machine as defined in claim 16, wherein the machine further comprises an air chamber arranged between the first unit and the heater for receiving and cooling compressed air and an expansion chamber for receiving hot, expanded air from the second unit, said air chamber and said expansion chamber being mounted on said cylinder-carrying supporting part for rotation therewith.

19. A piston machine as defined in claim 2, further comprising:

a stationary container containing pressurized working fluid;

conduit means for connecting the air container to one of the supporting parts;

a heater means carried on said one of the supporting parts for receiving the compressed working fluid from the conduit means and for heating same to an elevated temperature in a confined space; and second conduit means for passing the heated, pressurized fluid to an associated one of the cylinders, for driving the piston therein and the supporting parts of the machine by the force thereof.

20. A piston machine as defined in claim 2, further comprising:

an inlet valve means for admitting low-pressure working fluid into said cylinder; and conduit means for passing said working fluid at high pressure from said one cylinder to tank; and means for preventing reverse flow of fluid from said conduit means and tank to said cylinder, whereby the machine functions as a compressor when said driven shaft is driven by an external power source.

21. A piston machine as defined in claim 20, wherein said conduit means comprises a cooling coil for the compressed fluid, the cooling coil being affixed to and rotating with one of the supporting parts.

22. A piston machine as defined in claim 21, wherein the cooling coil communicates to tank through retaining ring means on the fixed shaft, and wherein said means for preventing reverse flow comprises a one-way valve.

23. A piston machine as defined in claim 19, wherein the piston corresponding to the one cylinder is hollow and said inlet valve means is carried therein.

24. A piston machine having a plurality of arcuately curved, interfitted pistons and cylinders arranged for rotation about a main shaft fixed in a housing, control means for communicating compressible fluid to the cylinders from a source, and a driven shaft journaled in said housing, the machine particularly comprising:

a first support part rotatably mounted about the main shaft and carrying said pistons;

a second support part rotatably mounted about the main shaft, spaced axially adjacent said first support part and carrying said cylinders;

a gear shaft carried rotatably in each of said first and second support parts and offset radially from said main shaft and parallel thereto;

cam means fixed in said housing adjacent said first and second parts;

a cam follower and a lever arm carried irrotatably on each of said gear shafts and arranged to engage and follow said cam means;

a pair of axial gears mounted about said main shaft on a unidirectional clutch means for free rotation in a direction of rotation of the support parts and for non-rotation in an opposite direction;

a pair of connector gears carried irrotatably on each of said gear shafts opposite said lever arm thereof, a first one of said connector gears on each said gear shaft engaging a respective one of said axial gears, and a second one of each of said connector gears on each said gear shaft engaging an inner gear segment arranged on the opposite support part;

a driven outer gear segment on each support part, the gear segments being sequentially engageable with the driven shaft on each full rotation of the support parts, whereby the cam means, gear shaft, cam follower and lever arms, axial gears, connector gears, and inner gear segments cause swinging of the first and second support parts relative to one another during their rotation, to move said pistons relative to said cylinders to conduct work operations with said compressible fluid.

* * * * *